US005127853A

United States Patent [19]

McMills et al.

[11] Patent Number: 5,127,853

[45] Date of Patent: Jul. 7, 1992

[54] FEEDTHROUGH COAXIAL CABLE CONNECTOR

[75] Inventors: Corey McMills, Los Altos; John Mattis, Sunnyvale; John A. Ross, Fremont; Jeff Sampson, Redwood City, all of Calif.

[73] Assignee: Raychem Corporation, Menlo Park, Calif.

[21] Appl. No.: 509,669

[22] Filed: Apr. 19, 1990

Related U.S. Application Data

[63] Continuation-in-part of Ser. No. 434,068, Nov. 8, 1989, which is a continuation-in-part of Ser. No. 364,917, Jun. 9, 1989.

[51] Int. Cl.[5] ..... H01R 17/04

[52] U.S. Cl. ..... 439/578; 439/433; 29/861

[58] Field of Search ..... 29/861-863; 439/578-585, 675, 586, 587, 592, 593, 877, 879

[56] References Cited

U.S. PATENT DOCUMENTS

| | | | |
|---|---|---|---|
| 2,805,399 | 9/1957 | Leeper | 333/6 |
| 3,196,382 | 7/1965 | Morello, Jr. | 339/117 |
| 3,264,602 | 8/1966 | Schwartz | 339/177 |
| 3,697,930 | 10/1972 | Shirey | 339/89 C |
| 3,710,005 | 1/1973 | French | 174/89 |
| 3,731,378 | 5/1973 | Toma et al. | 29/879 |
| 3,781,762 | 12/1973 | Quackenbush | 339/89 C |
| 3,963,321 | 6/1976 | Burger et al. | 339/177 E |
| 4,053,200 | 10/1977 | Pugner | 339/177 R |
| 4,173,385 | 11/1979 | Fenn et al. | 339/177 E |
| 4,249,790 | 2/1981 | Ito et al. | 339/177 E |
| 4,583,811 | 4/1986 | McMills | 339/177 R |
| 4,789,355 | 12/1988 | Lee | 439/584 |
| 4,834,675 | 5/1989 | Samchisen | 439/578 |

FOREIGN PATENT DOCUMENTS

| | | |
|---|---|---|
| 1565981 | 10/1969 | Fed. Rep. of Germany . |
| 621459 | 4/1949 | United Kingdom . |
| 2013420A | 8/1979 | United Kingdom . |

*Primary Examiner*—David I. Pirlot

*Attorney, Agent, or Firm*—A. Stephen Zavell; Herb Burkard

[57] ABSTRACT

A feedthrough coaxial cable connector includes a tubular mandrel body dimensioned to be pressed between a foil-bonded dielectric core and other elements of an outer conductor of the prepared end of the cable. The body has cable engagement surface which defines a knife edge projection therearound for engaging an outer conductor of the cable by creating shear stresses therein without actually shearing the outer conductor. A tubular shank portion extends from the cable engagement surface portion to a radial wall portion, and a jack engagement portion is coaxial about the exposed central conductor. The jack engagement portion achieves a tight friction fit upon a jack and may be formed as an inside compression collet. A radial copmression providing structure causes an inside surface region of the outer conductor to bear directly against and bend over the knife edge portion. Preferably, a slideable shell is slideably positionable generally away from a connector end facing the outer surface of the jack to enable the jack engagement portion of the connector to slide over the outer surface of the jack, and slideably positionable toward the connector end so as to radially compress the radially diverging jack engagement portion against the outer surface of the jack to secure the connector thereto. A kit of parts including an expendable installation tool enables proper asembly of the cable connector without special skills or tools.

68 Claims, 33 Drawing Sheets

FEEDTHROUGH COAXIAL CABLE CONNECTOR

NOTICE OF RELATED APPLICATION

This patent application is a continuation in part of U.S. patent application Ser. No. 07/434,068 filed on Nov. 8, 1989, now abandoned, which is a continuation in part of U.S. patent application Ser. No. 07/364,917, filed on Jun. 9, 1989 now abandoned.

FIELD OF THE INVENTION

The present invention relates to connectors for coaxial cables. More particularly, the present invention relates to a very low cost, easily installable feedthrough connector for coaxial cable of the type typically used indoors for wideband RF signal distribution, for example.

BACKGROUND OF THE INVENTION

Coaxial cable is in widespread use for distributing wideband radio frequency ("RF") information, such as television and radio signals. Coaxial cable typically provides two conductors, a central axial conductor and an outer conductor which is substantially concentric with the inner central conductor. The central conductor is typically completely surrounded by the outer conductor, and a low-loss, high dielectric insulation material, such as plastic foam, separates the two conductors. An outer insulating jacket is usually, although not necessarily, provided over the outer conductor to provide electrical insulation and physical protection to the cable. The outer conductor may be a single element, or it may be a composite of several layered elements of conductive foil, wire braid, etc. One element of a composite outer conductor construction may be a conductive film or coating applied to the outside surface of the low-loss, high dielectric insulation material.

Relatively large diameter, semi-rigid coaxial cables are widely used outdoors in cable television distribution networks as a delivery conduit for delivering the cable network signals to drop box locations near the service subscriber's premises. Smaller, more flexible coaxial cables having external insulating jackets are used to provide service drops to the subscriber premises.

Connectors are provided for connecting the cables in the outdoor environment. Such connectors not only must provide positive, signal-tight electrical connections, they must also provide positive leak-tight, sealed physical connections to prevent intrusion of moisture into the cable. Installation of such connectors typically requires cable end preparation such as coring or removal of the insulator dielectric core for some distance, followed by installation and tightening of the conductor assembly by a trained craftsperson, with or without special tools, depending upon the conductor/cable design. Typically, the outdoor environment connectors provide a central connector element which is secured in coaxial arrangement over an exposed end portion of the central conductor. The central connector element thus contributes significantly to the securement of the connector structure to the prepared cable end.

Usually, the distribution network operator does not want a subscriber to install a connector to a cable for use with "outside plant" distribution boxes, cables and the like; thus, special keyed tools are often provided for use by trained installers in order to preclude unauthorized access to system distribution boxes, service drops and the like.

Within the subscriber premises the opposite situation often exists. Usually, the subscriber has a number of appliances which require interconnection and connection to the service cable outlet jack, typically mounted to and extending outwardly from a wall plate within the home or other interior location, etc. Connections may be needed between the service jack and the jacks of a television set, a video cassette recorder ("VCR"), and a stereo FM receiver, for example.

Small diameter (approximately one quarter inch or smaller), flexible coaxial cables are typically employed to accomplish the needed connections. These coaxial cables typically include a solid wire central conductor, a foam core, an outer composite conductor formed of an inner aluminum coating on the foam core, one or more layers of open-mesh aluminum wire braid and one or more layers of an aluminum foil. The outer composite conductor is typically covered by a plastic outer insulator jacket of one or several layers of insulating material in order to complete the coaxial cable construction. The dimensions of such coaxial cables may vary, depending upon type and source thereof. Also, the properties of the cable may vary, depending upon type and source, and also depending upon such factors as ambient temperature. When ambient temperature is low, the polymer cable materials become very stiff and difficult to manouver during connector installation procedures. Also, the foil coated inner insulating core may vary in diameter from about 0.140 inch to as much as about 0.200 inch.

These small diameter cables have been made available to the consumer in standard lengths with connectors installed at the factory. Also, connectors have been made available for installation, but installation of these connectors to a prepared cable end has typically required a crimping tool for crimping a retaining ferrule, or a tool for spreading a retaining slip ring, or the tightening of a compression nut which retains the connector to the cable end, or the like. Some connectors for indoor service provide and require compressive coaction between the face of the threaded jack and the connector body, which is achieved in practice by tightening a threaded nut of the connector over the outer threads of the jack.

The connectors for indoor service are known as "feedthrough" connectors, in h sense that there is no separate central connector element of the connector provided for connection, the center conductor of the cable providing this element of the connection mechanism. The center conductor is usually engaged by a receptacle element of a jack. Such element, sometimes referred to as a center seizure mechanism, when present, provides a positive mechanical engagement between the connector assembly and the center conductor of the coaxial cable.

In the case of the feedthrough connector, an exposed end portion of the solid wire central conductor of the coaxial cable is directly engaged by the center seizure mechanism of the jack when the feedthrough connector is mounted thereon. Since the central conductor of the coaxial cable is not maintained in mechanical engagement with the feedthrough connectors, and since those connectors function only to feed or connect the outer conductor to the jack and thereby to position the exposed central conductor for engagement with the central gripping mechanism of the jack, the prior techniques for securing the connector to the cable have proven to have drawbacks related to installation and have proven not to be entirely satisfactory for ready installation and extended, reliable use within indoor use environments.

Irrespective of the particular approach followed by the prior art, hitherto there has not been a very low cost feedthrough coaxial cable connector which may be easily assembled and attached to the cable with a simple manipulation by a user without special tools, or skills, and which provides a positive, superior engagement over time with the jack to which it is mated for use.

A wide variety of techniques are to be found in the coaxial cable connector art for attaching a feedthrough connector to a prepared cable end. One representative example is to be found in the Quackenbush U.S. Pat. No. 3,781,762. Therein, a tubular connector body includes an annular flare. The body is dimensioned to fit between the insulating core and outer conductor of the prepared cable end, and it aligns and positions an exposed end section of the central conductor. The annular flare of the tubular body causes the outer conductor to become stretched over it as the body is pushed between the core and the outer conductor during installation. A cylindrical ferrule, such as a split ring or crimp ring, is then installed over the body inside of the annular flare. The Quackenbush arrangement is said to provide good electrical and mechanical connection of the cable outer conductor to the connector body. However, the Quackenbush connector cannot be easily installed on the prepared cable end without special tools needed for installation of the clamping ferrule.

As mentioned, another feedthrough connector relies upon a compression engagement obtained by tightening a threaded nut to the jack. The tightened nut of the connector compresses the outer conductor against the connector body and thereby secures the connector to the cable. One drawback of this approach is that when the nut is not tightened upon the threaded jack, or when the connector end is not engaged with the jack, a slight tug or jerk on the connector may cause it undesirably to become separated from the cable.

Other more conventional approaches are to be found in the coaxial cable connector art which include means for engaging the exposed end of the central conductor. For example, British Patent Specification 621,459 describes a tubular connector body for insertion between the insulation core and the outer conductor of a coaxial cable. An annular flared or bulged region expands the outer conductor of the cable, and a longitudinally extending split ferrule tube is pushed over the coaxial cable end to surround the body at the bulged region so as to press the cable against the bulged region to improve electrical connection and mechanical attachment. The ferrule includes fingers enabling it to be secured to the connector body after it is positioned in place.

An annular split ring is described in the Leeper U.S. Pat. No. 2,805,399 in order to retain an outer conductor of a coaxial cable along an arrow ring location immediately adjacent a bulged annular frustoconical clip portion of a body which is slipped under the outer conductor of the coaxial cable in order to provide very secure mechanical retention of the cable to the connector. Here, a special tool is needed in order to position and install the slip ring.

In the Pugner U.S. Pat. No. 4,053,200, a connector body has two radially raised portions. A plural-fingered, elongated brass ferrule slides over the cable and the outer radially raised portion in order to seat or nest between the two raised portions of the body and press the outer conductor of the cable against the connector body. While the elongated brass ferrule provides a radial band of circumferential compression force to press the cable outer conductor against the tubular body, similar to the manner described in the Quackenbush reference discussed above, no engagement is provided between the elongated ferrule or other structure of the connector and the cable behind the outer raised portion of the connector body. Apparently, to aid requisite securement of the cable to the connector, the Pugner reference teaches a central connector structure which is crimped or otherwise secured to an exposed end section of the central conductor of the cable.

Without the further retention means by the central connector structure as shown in the Pugner patent, tugging and pulling stresses upon the coaxial cable will tend to cause it to become disconnected from the connector as described by Pugner, especially if the connector is threaded onto the jack at the time. Also, any flexures of the cable, particularly within an indoor environment such as the home, will tend to cause the outer conductor to stretch and possibly to lose effective electrical contact with the ridge of the outer raised portion and/or provide an unwanted signal leakage path at the connector.

The Schwartz U.S. Pat. No. 3,264,602 provides a connector body for a coaxial cable which has a rearwardly tapered, ringed frustoconical surface which is slipped under the outer conductor of the coaxial cable. An outer member snap-locks over the cable in a manner which compresses the outer conductor against the frustoconical surface in order to lock the cable to the connector and to provide a positive electrical connection between the inner surface of the outside conductor of the cable and the facing frustoconical ringed surface of the conductive connector body.

The Lee U.S. Pat. No. 4,789,355 provides a coaxial cable connector plug which has tines or leaves which slide over the threaded end of the jack. An outer annular sleeve may then be pushed forward over the tines in order to compress them against the threaded jack and lock the connector plug against the jack in the manner of a compression collet, even though the plug is not threaded to mate with the threads of the jack.

The Samichisen U.S. Pat. No. 4,834,675 describes what the inventor calls a "snap-n-seal" coaxial cable connector for a prepared end of a coaxial cable. This four-part connector assembly includes a mandrel body 30 which has a ramped contour 39 diverging from the rear end thereof, so that the body 30 may be press fit between the dielectric core and the shielding braid. As seen in FIG. 2B and as best seen in FIG. 4, the ramped contour 39 appears to flatten out and ends at a step inwardly forming a right angle with the flattened region. A plastic compression sleeve 60 is pushed over the body 30 and the cable end. The compression sleeve snap-locks into a metal collar member 20 and is said thereby to lock the cable end to the connector assembly. Since the ramped contour 39 appears to end at a flattened region, the body 30 fails to provide a knife edge for effectively cutting into the braid or aluminum sheet forming the outer conductor of the coaxial cable.

The Ito et al. U.S. Pat. No. 4,249,790 describes a push-on type connector plug for a coaxial cable end. In pertinent part, the connector plug includes a slotted shield casing forming a plurality of resilient fingers which engage the outer cylindrical surface of a connector receptacle as the connector plug is pushed onto the receptacle. The fingers appear to be contoured to cooperate with an outer band structure in order to provide a spring bias force which pushes the fingers against the outer cylindrical surface of the receptacle and thereby provide a good electrical and mechanical push-on, pull-off attachment.

The Morello Jr. U.S. Pat. No. 3,196,382 describes a crimp type coaxial cable connector 12 which includes a mandrel body having an integrally threaded mating cap for mating with a receptor connector 14. The Morello Jr. connector device is not a push-on feedthrough connector.

While the foregoing approaches recognize the problem of providing effective contact and positive mechanical attachment of the prepared cable end and the cable connector, none of the foregoing approaches achieve a simplified, easily installed, positively acting feedthrough coaxial cable connector intended primarily for ready installation by the untrained user or consumer or by the trained technician, and for reliable use typically within an indoor environment over an extended time period.

SUMMARY OF THE INVENTION WITH OBJECTS

A general object of the present invention is to provide a feedthrough coaxial cable connector which overcomes the limitations and drawbacks of the prior art.

A more specific object of the present invention is to provide a feedthrough coaxial cable connector for indoor use which may be installed by a user with exertion of but moderate finger strength and without any special tools or skills being required.

One more specific object of the present invention is to provide a feedthrough coaxial cable connector which achieves improved flexual strain relief against rearward pulling force thereby to prevent the cable from being disconnected from the connector in response to tugging or pulling forces whether or not the connector is pulled free of the jack. That is to say, a specific object of the present invention is to provide a feedthrough coaxial cable connector which preferentially releases from a jack with which it is mated, rather than becoming damaged and inoperative by separation of the connector and the coaxial cable end.

Yet another specific object of the present invention is to provide a kit of a few co-acting parts which may be assembled and installed by the consumer as a connector on an easily prepared end of an indoor coaxial cable by hand without special tools and without special training or skills.

Still a further specific object of the present invention is to provide a retenton ring having a resiliently deformable portion of elastomeric material which coacts with an annular or helical blade edge forming an annular or helical barb of a mandrel body underlying the outer conductor, so that once locked in place, the resiliently deformable portion of the retention ring effectively locks the cable onto the connector and impedes rearward tugging forces from causing the cable end to be detached from the connector.

Yet one more specific object of the present invention is to provide a mandrel body for a coaxial cable connector which has an annular or helical blade edge forming a sharply contoured surface projecting outwardly from a substantially tubular mandrel body portion, and to use an elastomeric retention ring to cause an aluminum foil and braded wire portion of an outer conductor of the coaxial cable to be contacted by the blade edge in a way which fosters positive long term connection to the foil and braded wire conductor elements without formation of insulating oxides and without actually shearing the fine wires of the outer conductor braid, so that the connector will operate reliably throughout wide ranging temperature cycles of the ambient surroundings and without impairment resulting from occasional movement and tugs on the cable.

Still one more object of the present invention is to provide, most preferably by die casting, a mandrel body including a tubular portion defining an annular or helical blade edge forming a sharply contoured surface projecting outwardly from the tubular portion. The tubular portion may be formed to act as a collet in order to engage differently dimensioned coaxial cables within a predetermined dimensional range. In this object ramping is effectively promoted with the aid of an expendable conically shaped guide for providing a ramp between the different cable diameters.

Yet one more object of the present invention is to provide a nesting tool for containing a kit of parts comprising the elements of the cable connector in a manner which facilitates proper and ready assembly of the elements into an installed feedthrough connector at the prepared end of a coaxial cable.

A feedthrough coaxial cable connector is provided for connecting to a prepared end of a coaxial cable having an exposed solid-wire central conductor. In accordance with the principles of the present invention, the connector includes a tubular mandrel body of conductive material such as yellow brass which has been plated with a suitable metal or alloy, such as tin, in order to improve lubricity, for example. The tubular mandrel body is dimensioned to be pressed between a foil-bonded dielectric core and other elements of an outer conductor of the prepared end of the cable.

In one presently preferred embodiment, the mandrel body preferably includes a rearwardly converging, generally frustoconical surface portion defining a shallow angle with respect to the cable, a first radial wall portion defining a knife edge with the frustoconical surface portion, a tubular shank portion extending from the first radial wall portion to a second radial wall portion, and a jack engagement portion coaxial about the exposed central conductor and dimensioned to fit on and contact an outer surface of a jack with which the connector mates in use. The jack engagement portion is preferably adapted to diverge radially from the second radial wall portion thereby enabling an initial slide-on engagement with the outer surface of the jack. A tight friction fit is desireably achieved between the jack engagement portion and the outer surface of the jack. In one preferred form, the jack engagement portion defines an inside compression collet structure. Preferably, the mandrel body is formed by die casting, in preference to machining.

In another aspect the mandrel body preferably includes a helical barbed thread extending radially outwardly therefrom in the nature of a shallow, spaced apart continuous thread of controlled sharpness to enable the mandrel body to be rotatably inserted onto the prepared cable end by threading into the underside of the outer conductor, thereby to establish a positive electrical connection, as well as a positive mechanical connection, but without actually shearing the fine wires typically forming at least a part of the outer conductor.

A radial compression providing structure, which preferably may include a flanged or splined snap-ring, includes a resiliently deformable elasomeric portion which is shaped and dimensioned to cause an inside surface region of the outer conductor to bear directly against and bend over the knife edge barb formed by the first radial wall portion at the inside end of the frustoconical portion of the mandrel body.

Preferably, a slideable shell is disposed over at least the jack engagement portion of the mandrel body. The shell is slideably positionable generally away from a connector end facing the outer surface of the jack to enable the jack engagement portion of the connector to slide over the outer surface of the jack, and is slideably positionable toward the connector end so as to radially compress the radially diverging jack engagement portion against the outer surface of the jack to enable the the connector to be securely connected thereto in a positive friction fit.

In one aspect of the present invention, the slideable shell further defines a radial portion for compressing a region of the coaxial cable outer conductor against the frustoconical surface portion of the mandrel body when the slideable shell is slideably positioned toward the connector end.

In another aspect of the present invention, the jack engagement portion is slotted longitudinally to form a slip ring for slideable engagement over the outer surface of the jack.

In a further aspect of the present invention, the jack engagement portion includes plural slots, and it functions as a compression collet to lock onto the outer surface of the plug as the slideable shell is positioned toward the connector end facing the jack.

In one more aspect of the present invention, the snap ring includes a cap portion for fitting snugly over the jack engagement portion of the mandrel body thereby to provide initial additional strength to resist hoop stresses that may develop in the jack engagement portion before the slideable shell means is positioned toward the connector end facing the jack.

In still a further aspect of the present invention, the slideable shell is adapted to guide the snap ring into position over the coaxial cable end and adjacently against the first radial wall region of mandrel body during installation of the connector onto the prepared end of the coaxial cable.

In a somewhat different aspect of the present invention a method is provided for assembling a feedthrough coaxial cable connector from a kit of parts at an end of a coaxial cable, the method comprising the steps of:

preparing an end of the cable by peeling back a first cylindrical portion of outer insulator covering for a first length to expose an outer conductor braid/foil layer, and peeling back the outer conductor braid/foil layer and coaxially underlying dielectric insulator for a second length shorter than the first length thereby to expose a center solid conductor wire end portion, providing a kit of parts by the steps of preforming a tubular mandrel body of conductive material dimensioned to be pressed between a dielectric core and an outer conductor of the prepared end of the cable, the mandrel body as preformed including an annular or helical knife edge surface extending from a tubular shank portion, a radial wall portion extending radially outwardly from the tubular shank portion, and a coaxial jack engagement portion extending forwardly from the radial wall portion and coaxially disposed about the exposed central conductor and dimensioned to slide onto and contact an outer surface of a jack with which the assembled connector mates in a close fitting friction engagement, and preforming a radial compression member for compressing the inside surface of the outer conductor of the coaxial cable over the knife edge of the tubular mandrel body installation, sliding the radial compression member over the prepared cable end in one direction of movement away from the prepared end, installing the mandrel body onto the prepared end of the cable by pushing it onto the cable end in the case of the annular knife blade or rotating it onto the cable end in the case of the helical knife blade, and sliding the radial compression member over the prepared end of the cable installed on the mandrel body so as to compress the inside surface of the outer conductor of the coaxial cable over the knife edge of the tubular mandrel body.

The radial compression member may be preformed as a retention or snap-ring, and the kit of parts may further advantageously include an outer shell which cooperates with and co-acts with the snap-ring to position it during assembly and installation and further to compress the jack engagement portion against the jack when the assembled connector is in use in its intended manner. A "throw-away" installation tool which enables the kit of parts to be nested for delivery to the user and which facilitates ready and easy assembly and installation of the connector onto a prepared end of the coaxial cable is yet another aspect and advantage of the present invention. The tool may also provide a visual gage for installation, and it may also be adapted to self-release, once the connector elements are properly installed on the prepared cable end.

These and other objects, aspects, advantages and features will be more fully understood and appreciated upon consideration of the following detailed descripion of preferred embodiments, presented in conjunction with the accompanying drawing.

BRIEF DESCRIPTION OF THE DRAWINGS

In the Drawings:

FIG. 33 is an exploded view of the connector assembly in elevation and partial section along a longitudinal explosion axis.

DETAILED DESCRIPTION OF PREFERRED EMBODIMENTS

Figure 1:
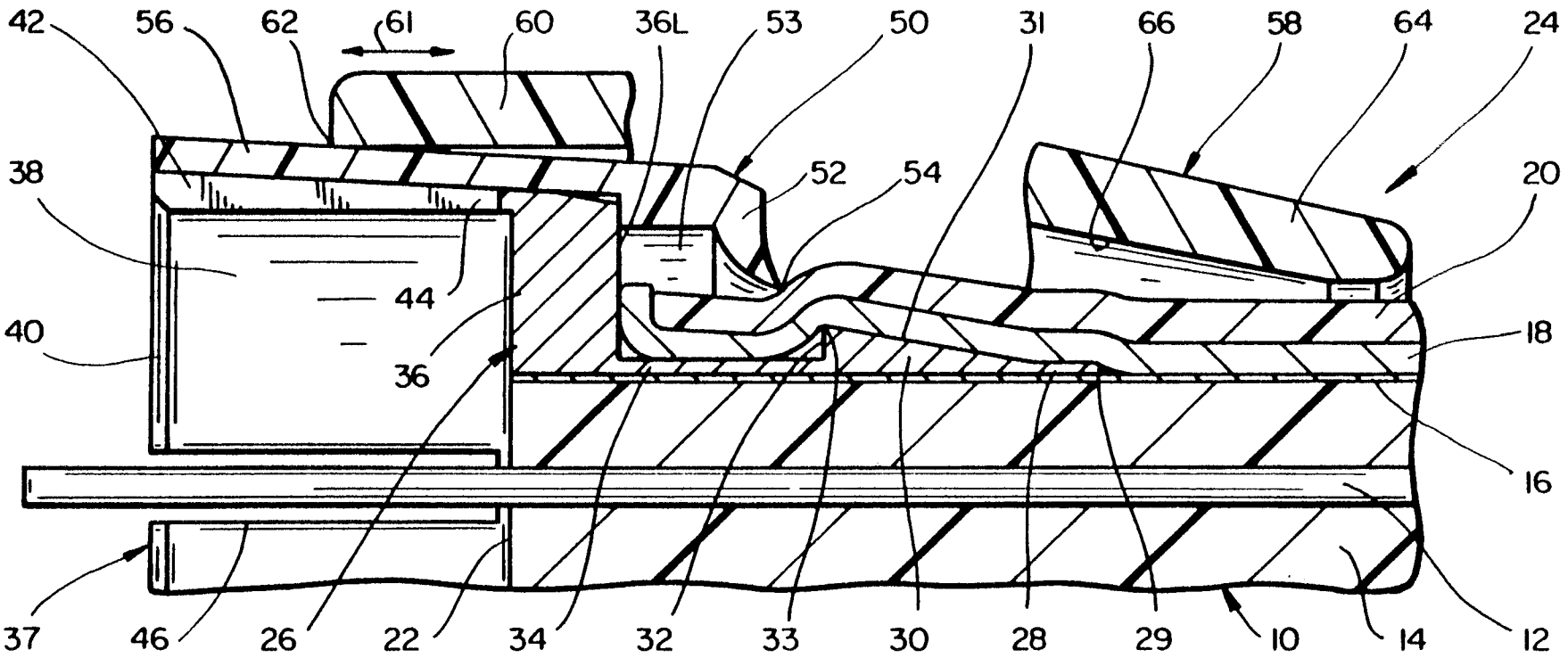
FIG. 1 is a greatly enlarged partial view in elevation and longitudinal section along a central axis of a portion of a coaxial cable connector incorporating principles of the present invention.

With reference to FIG. 1 a coaxial cable 10 includes a central longitudinal conductor 12 which is concentrically surrounded by a high dielectric, insulator material 14, such as plastic foam for example. A thin metal conductive foil or coating 16, typically formed of aluminum alloy, is bonded to the outer surface of and thereby contains the foam core 14 and embedded central conductor 12. An open mesh wire braid or wrap 18 is wrapped or placed immediately outside of the outer metal coating 16 to provide mechanical strength to the cable and yet, to permit the cable 10 to flex quite freely without damage. Additional layers of aluminum foil and wire braid may be included as part of a composite outer conductor. Together, these composite elements 16, 18 form an outer electrical conductor and shield which is substantially concentric with, and spaced (by the dielectric core material 14) away from the center conductor 12.

An outer insulator coating 20 of a suitable thermoplastic resin material covers the outer electrical conductor to seal the cable from the ambient, to isolate the outer conductor electrically from the ambient and to provide some additional stiffness and mechanical protection to the cable 10.

The cable 10 may be type RG-6 having a nominal overall diameter of about 0.275 inch, or a type RG-59 having a nominal overall diameter of about 0.240 inch. The diameter of the inner core material 14 of the RG-6 cable is about 0.185 inch, whereas the diameter of the inner core material 14 of the RG-59 cable is about 0.145 inch, thereby illustrating a core diameter variance range of about 0.040 inch between two very popular indoor cables.

As shown in FIG. 1, the end of the cable 10 has been prepared by cutting back the outer conductor 20, outer braid 18, outer foil jacket 16 and dielectric core 14 for a short distance to a location referred to by the lead line associated with the reference numeral 22 in FIG. 1, so as to expose a short segment of the central conductor 12. The exposed segment of the central conductor 12 is engaged by a central conductor receptacle within a conventional jack typically having a threaded outer cylindrical surface. The jack may be a standard threaded "F" port connector having a nominal outer diameter of about 0.375 inches although this diameter is known to vary somewhat in practice.

As shown in FIGS. 1 and 2A through 2G, a preferred embodiment 24 of a connector incorporating the principles of the present invention includes a mandrel body 26 formed of a suitable conductive material, such as yellow brass, for example. Preferably, the mandrel body 26 is die cast with a two-part mold that separates along the longitudinal axis of the mandrel body 26. As formed by die casting, for example, the mandrel body 26 is formed with suitable reliefs and edge contours, so that it cooperates as intended with the other structural elements of the connector without scratching or unwanted interferences. By employing a die casting operation, rather than machining, each mandrel body 26 may be formed in less than one second, leading to substantial economies in manufacturing. Preferably, the mandrel body 26 is plated with a suitable metal or alloy, such as tin, in order to improve its lubricity characteristics.

The conductive mandrel body 26 includes a thinned tubular region 28 with a slight, axially converging chamfer 29 at the end of the body 26. A frustoconical region 30 forms a frustoconical outer surface region 31. Preferably, the frustoconical outer surface region 31 forms an acute angle (less than 90 degrees) with a central longitudinal axis of the mandrel body 24 (which is generally in alignment with the central conductor 12 of the coaxial cable 10). Preferably, the angle formed by the surface region 31 with the longitudinal axis is between about 20 degrees and about 5 degrees, and it is preferably 10 degrees, plus or minus one degree.

A first, radially extending annular wall 32 extends outwardly to converge the inner end of the frustoconical surface 31 thereby to form an annular knife-edge projection or barb 33. The barb edge 33 is designed to be a cutting surface which cuts or bites slightly into an inside ring portion of the outer metal braid and foil layers 18 without actually shearing them, thereby to cut through any oxide or other insulating formations or deposits on the inside surface of the metal foil 16 so as to achieve and maintain a positive, very low resistance electrical connection between the mandrel body 26 and the outer conductor foil and braid 18. As seen in FIG. 1, the frustoconical surface 31 forms an acute angle with the annular wall 32, most preferably about 30 degrees.

A thinned tubular region 34 extends away from the base of the first radial wall portion 32 and meets a thickened second radial wall portion 36. The second wall portion 36 extends radially outwardly to the location of a collet structure 37 at which fingers or leaves 38 extend. The fingers 38 define the inside collet structure 37 and provide an inside cylindrical engagement surface suitable for engaging the outer threaded surface of a jack with which the connector 10 is intended for use, such as an "F" jack, for example. The inside surface of the collet structure 37 may be smooth, as shown in FIG. 1, or it may be provided with a shallow-cut helical groove or thread 39 as shown in FIG. 2C. A radially diverging chamfer or bevel edge 40 at the entrance of the collet structure of fingers 38 facilitates slidable engagement of the leaves or fingers 38 upon the threaded surface of the jack. The pitch of the groove 39 is set to correspond with the thread pitch of the jack. If the groove 39 is present, a more positive attachment is achieved with the threaded jack than if the thread 39 is not provided, should such a characteristic be desired.

Preferably, each finger 38 is formed with a thickened region 42 adjacent to the chamfer 40 and becomes gradually thinned at a region 44 adjacent to the second, thickened radial wall portion 36. The inside geometry of the connector 24 is generally cylindrical when in an unstressed, uncompressed state. In this relaxed state which enables the conductor 24 to be slid over the outer surface of the jack, the outer surfaces of the fingers 38 define a slightly curved or frustoconical geometry. Preferably, there are four fingers 38 provided by the mandrel body 26. There may be more or fewer fingers; however, four fingers 38, each defining a quadrant of a cylinder and separated by longitudinal slots 46 from adjacent fingers, cooperate to provide a very effective compression collet closure structure for positive engagement over the outer surface of the jack, when a hoop, band, slip ring, or other circumferentially compressing member is slidably positioned over the thickened regions 42 of the fingers 38. The fingers 38 may be formed by cross-sawing across the collet structure 37 at right angles, as shown in FIG. 2B, for example. Alternatively, and preferably for mass production, the fingers 38 are formed by a single machining operation of two parallel saws which move in one direction across the collet structure 37, as shown in FIGS. 2D and 2E.

The connector 24 further includes a resiliently deformable elastomeric cap 50 which is preferably formed by injection molding of a suitable thermoplastic resin material. The cap 50 includes a deformable flange region 52 which becomes thinned and tapered into a rearwardly flaired, knife-like annular edge 54. When the cap 50 is properly positioned over the mandrel body 26 and cable 10, a cap region 56 snugly fits over the fingers 38 and provides some additional hoop strength and protection to the fingers 38 from overbending due to proper insertion into the jack.

Figure 2A:
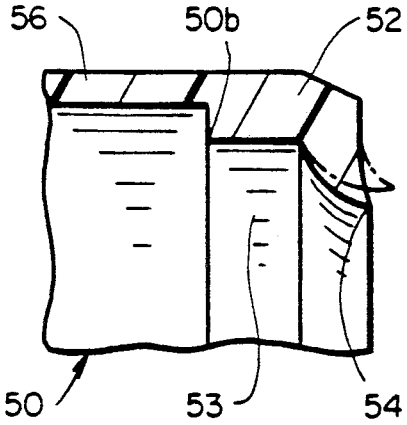
FIG. 2A is a greatly enlarged diagrammatic view in elevation and longitudinal section of a portion of a resiliently elastomeric snap ring element of the FIG. 1 connector.
Figure 2B:
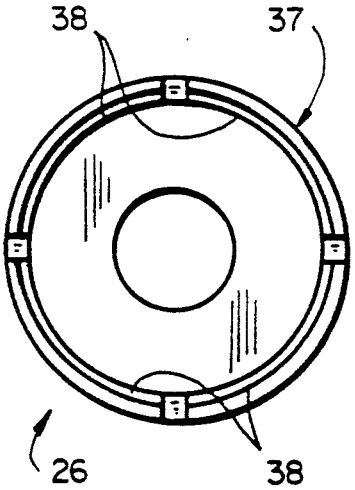
FIG. 2B is an end view in elevation of the inside collet structure of the mandrel body of the FIG. 1 connector.
Figure 2C:
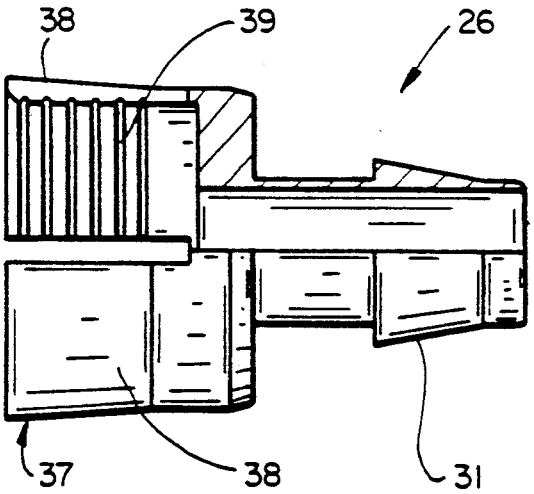
FIG. 2C is a view in elevation and partial section of the mandrel body of the FIG. 1 connector modified to define an inside helical thread within the collet structure portion thereof.
Figure 2D:
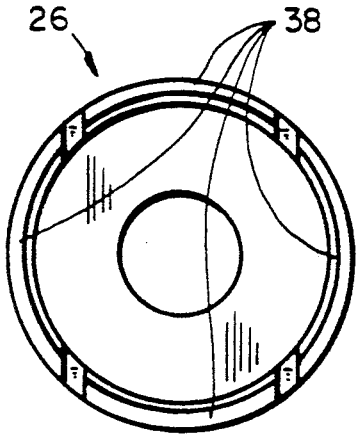
FIG. 2D is an end view in elevation of the inside collet structure in which the fingers thereof are formed by parallel saws.
Figure 2E:
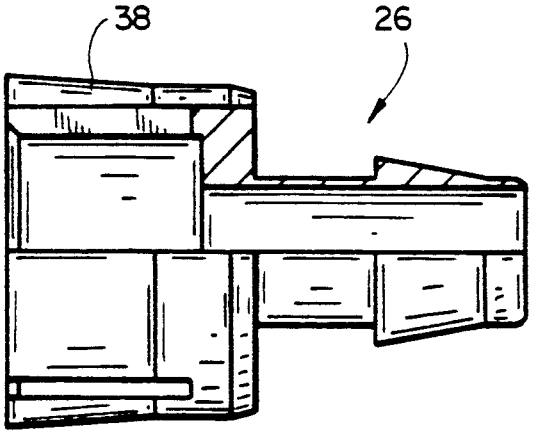
FIG. 2E is a view in elevation and partial section of the FIG. 2D mandrel body.
Figure 2F:
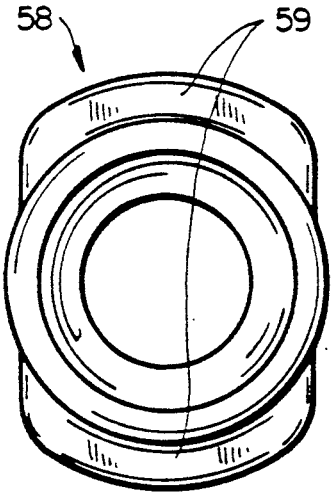
FIG. 2F is a view in front elevation of an outer shell of the FIG. 1 connector.
Figure 2G:
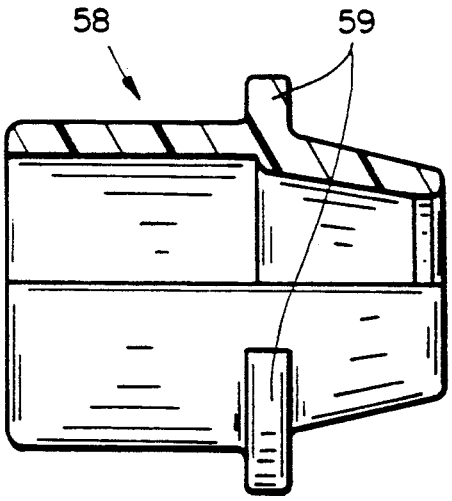
FIG. 2G is a view in partial section and side elevation of the FIG. 2F outer shell.

As shown in FIG. 2A, the cap 50 is dimensioned such that the flange region 52 snap-locks into a recess formed adjacent to the first radial wall 32 of the mandrel body 26. Since the flange region 52 is initially flaired outwardly, the thinned annular edge 54 curls up around the outer plastic insulation 20 and tends to stretch or pull it down over the knife edge 33 of the mandrel body 26. When positioned against the outer insulator 20 of the cable 10, the flaired edge 54 of the cap 50 actually presses the cable 10 against the first radial wall portion 32, causing the outer conductor braid and foil layers 18 to become sharply creased at the knife edge 33. This resultant crease not only prevents aluminum oxide from impeding a very low resistance, high conductance contact between the outer conductor and the conductive mandrel body 26, it also effectively prevents rearward displacement of the cable 10 relative to the conductor 24. In effect, tugging forces applied to the cable 10 will cause the connector to become disconnected from the jack, rather than result in separation of the cable end from the conductor, given the acute angle of the knife edge 33 of the mandrel body 26 and the compressive action of the flaired edge 54 of the elastomeric cap 50.

Preferably, an outer shell 58 is provided which further cooperates with and strengthens the connector 24. The shell is formed by injection molding of a hard plastic material, such as 6/6 nylon. As diagrammed in FIG. 1, the shell 58 has a forward cylindrical portion 60 which is dimensioned to compress the mandrel fingers 38 against the outer surface of the jack when the portion 60 is slid forward along an axial locus denoted by the arrow 61. An inside edge region 62 of the portion 60 bears against the cap region 56 which in turn presses inwardly against and compresses the fingers 38 toward the outer surface of the jack in the manner of a compression collet.

At the same time, a rear, frustoconical portion 64 of the shell 58 positions an inside surface 66 against a region of the outer plastic insulator 20 adjacent to the frustoconical surface 31 of the mandrel body 26. The inside surface 66 thereby clamps the insulator and outer conductor jacket against the surface 31, thereby preventing relative movement of the cable 10 relative to the connector 24 and particularly relative to the knife edge 33, and further accentuating the creasing action of the outer conductor jacket over the mandrel knife edge 33 and preventing rearward movement relative to the connector 24.

The outer shell 58 must have a sufficiently high modulus of elasticity and resilience to stretching so that it effectively closes the fingers 38 of the collet structure 37 as the shell 58 slides forward over the mandrel body 26. Since "F" jacks are found in practice to range in diameter over about an 0.015" range, the sizing of the inside diameter of the edge region 62 should be such that when the front edge of the outer shell portion 60 is slid about halfway over the collet structure 37, a secure grip is thereby achieved between the structure 37 and a jack of nominal diameter, e.g. 0.375 inches. In this manner, smaller and larger diameter jacks of the "F" type, for example, may be securely engaged by the connector 24, particularly if the inside surface of the collet structure 37 is provided with the shallow thread 39, as shown in FIG. 2C. A modulus of elasticity of at least 100,000 pounds per square inch, and a resiliency enabling stretching up to about four percent of nominal are presently preferred characteristics for the outer shell 58.

An oxide-formation preventing gel may be coated onto the mandrel body 26 on the radial wall portion 32 adjacent to the knife-edge 33, or on the frustoconical surface 31, or at both locations as desired. The gel may have lubricating properties and may facilitate insertion of the mandrel body 26 between the dielectric core 14 and the outer conductor foil jacket 16. Gels under compression, such as disclosed in commonly assigned U.S. Pat. Nos. 4,634,207; 4,643,924; 4,721,832; and, 4,701,574, the disclosures of which are hereby incorporated by reference, are suitable for use with the embodiments of the present invention disclosed herein.

Also, with the connector 24, a space 53 is provided between the thickened radial portion 36 of the mandrel body 26 and the flaired region 52 of the deformable elastomeric cap 58. This space 53 enables excess outer cable material to be curled up and accomodated, further relaxing the tolerance requirements for preparation of the end of the cable 10 for installation of the conductor 24.

Figure 3:
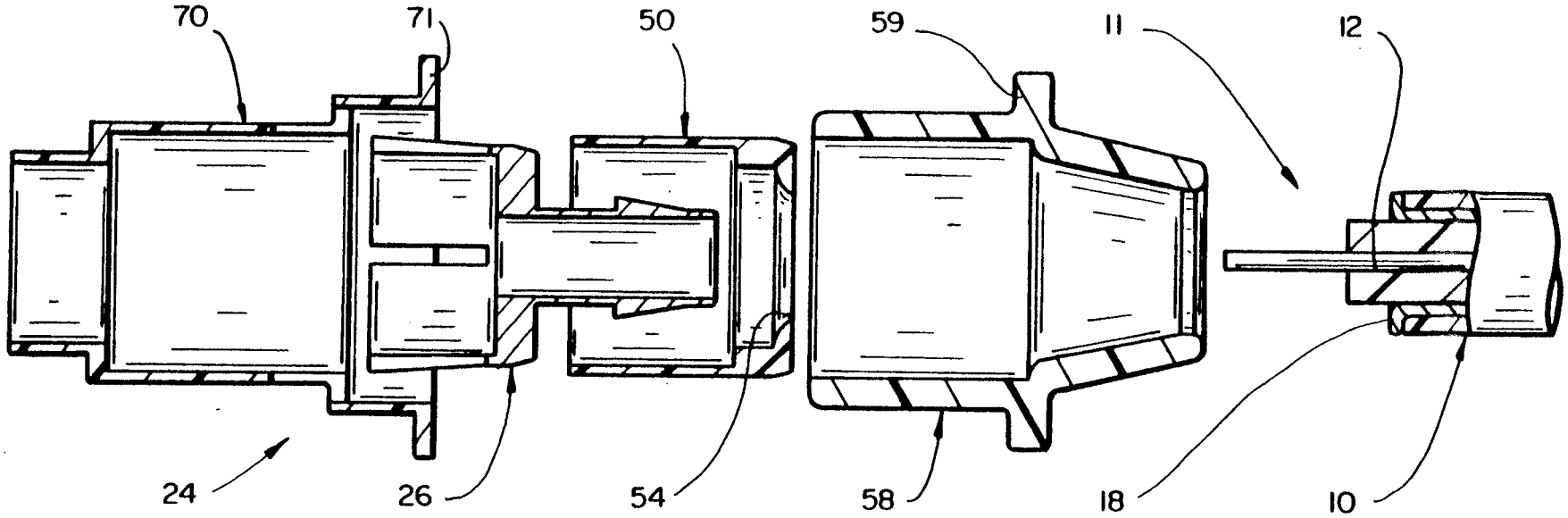
FIG. 3 is a longitudinally exploded view of the FIG. 1 connector about to be installed on a prepared cable end of a coaxial cable with the aid of one form of expendable plastic assembly tool or jig.

Turning to FIGS. 3–7, an assembly sequence of a kit of parts which will eventually comprise the connector 24 is illustrated. Therein, a molded plastic assembly tool or jig 70 is shown in axial alignment with the other components previously discussed in conjunction with FIGS. 1 and 2. In FIG. 3, an end 11 of the cable 10 is prepared as shown, so that the foam core 14 and exposed outer coating 16 extend a small distance beyond the outer insulator 20, and braid and aluminum foil layers 18. The braid and foil layers 18 are folded up and radially outwardly away from the longitudinal axis of the cable 10. The cable end 11 may be prepared with a special tool, or simply by using a sharp knife or single edge razor blade. The stubby wires of the braid and foil layers 18 are folded back by the installer's finger after the ring of outer insulator coating has been cut away.

Figure 4:
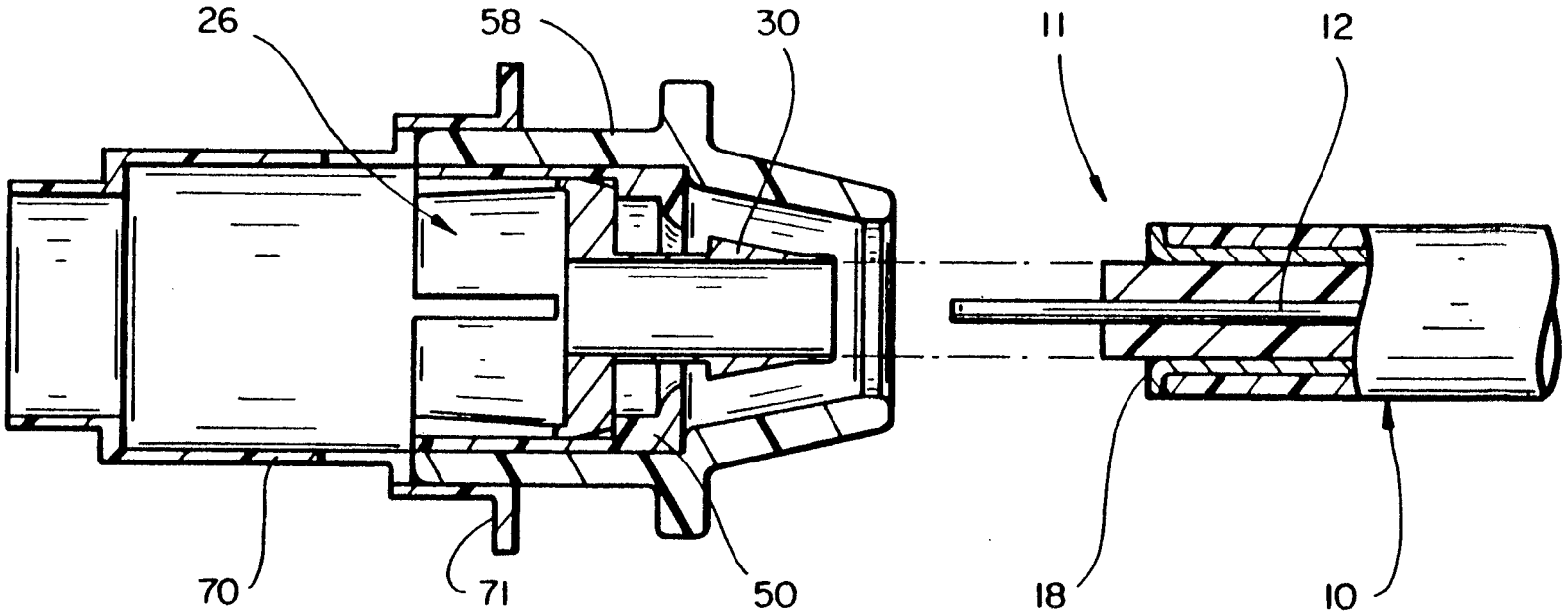
FIG. 4 shows the FIG. 3 assembly nested within the assembly jig incident to installation of the FIG. 1 connector onto the coaxial cable end.

In FIG. 4, the mandrel body 26, cap 50 and outer shell 58 are nested into the assembly tool 70 in preparation for receiving the prepared cable end 11 as shown therein. A annular ring portion 71 of the tool 70 provides a convenient grip location for the user's fingers. The cable is gripped in one hand, and the assembly tool 70 containing the body 26, cap 50 and outer shell 58 is gripped in the other hand. Then, the cable is pushed toward the tool 70 and into and through the the outer shell and cap 50. When the cable engages the mandrel body 26, it pushes the body forward and away from the cap 50 and outer shell 58, as shown in FIG. 5.

Figure 5:
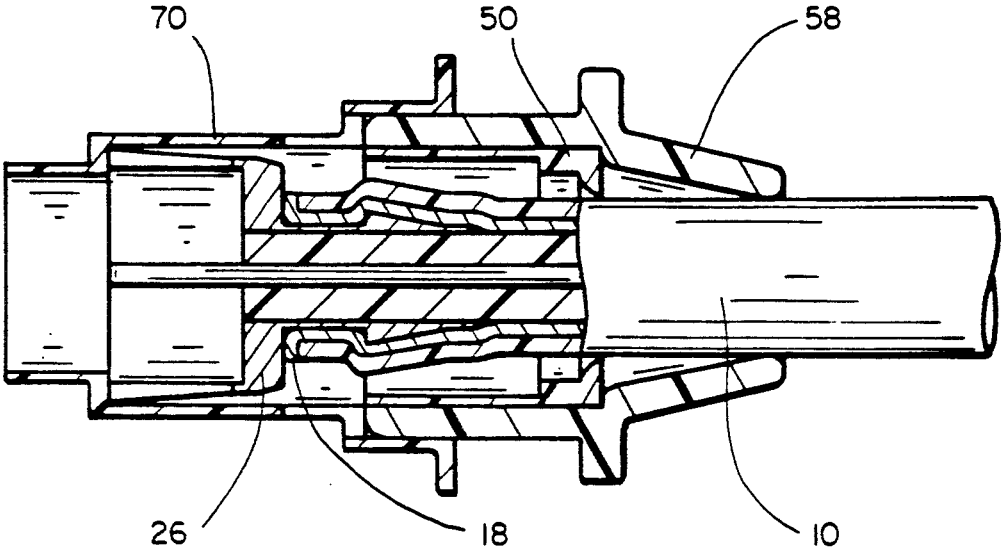
FIG. 5 shows the FIG. 4 assembly with the coaxial cable installed thereon.

In FIG. 5, the cable end 11 is shown inserted into the tool 70 and the end has pushed the mandrel body 26 to the forward end of the tool 70, passing over and leaving behind the cap 50 and the shell 58. If the tool 70 is formed of a transparent plastic material, then it is possible for the installer to see that the cable end 11 has passed over the frustoconical region 30 and the thinned tubular region 34 and is butted up against the outside of the second radial wall portion 36. In this manner the transparent tool 70 acts as a gage for aiding proper installation. When the cable has reached the desired position, as shown in FIG. 5, the cable 10 is then pulled away from the tool 70, with the installer grasping the outer shell 58.

As the cable 10 and mandrel body 26 are drawn rearwardly, the outer shell 58 retains the cap 50 and causes it to slip over the cable 10 and over the annular bulge therein now formed by the outer jacket elements lying upon the surface 31. Continuing to pull the cable 10 relative to the shell 58 causes the cap 50 to be moved into its final locking position over the thinned tubular region 34 in front of the first wall portion 33, as shown in FIG. 1. The cap 50 is thus snap-locked against the outer insulator 20 at the vicinity of the radial wall 32 and prevents rearward movement of the cable 10 by coaction with the knife edge barb 33 of the mandrel body 26.

It will be appreciated that the tool or jig 70 forms a convenient package for containing a kit of parts including the mandrel body 26, snap-lock cap 50 and outer shell 58. A "blister-pack" package may include the tool and parts and be formed onto a cardboard substrate for convenient distribution to the householder or other installer/user of the connector 24. The substrate may conveniently provide printed instructions and illustrations for assembly and use of the connector 24.

Figure 6:
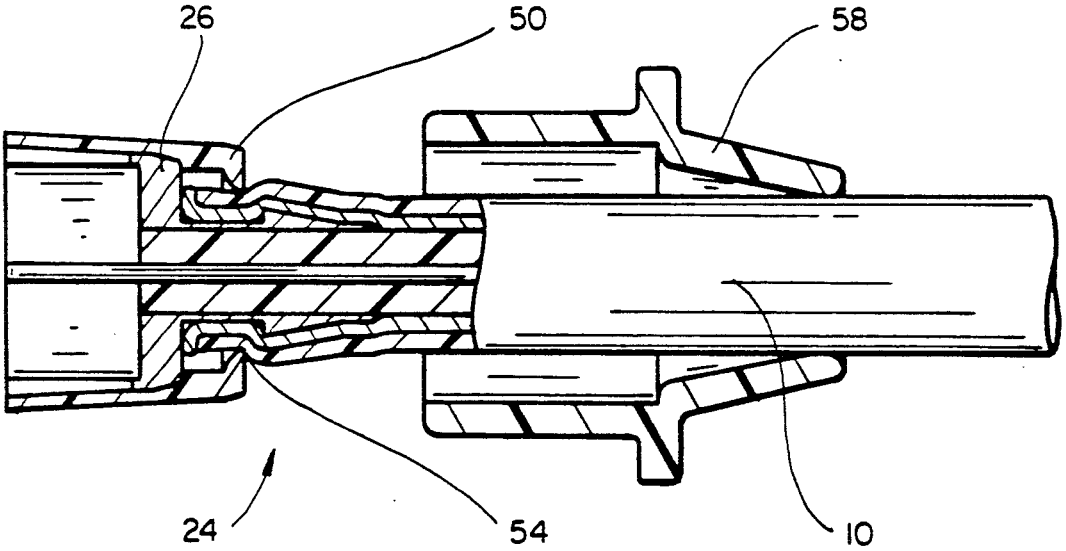
FIG. 6 shows the installed connector assembly with the outer shell element slid back to a position enabling the connector to be installed on a receptacle or jack.
Figure 7:
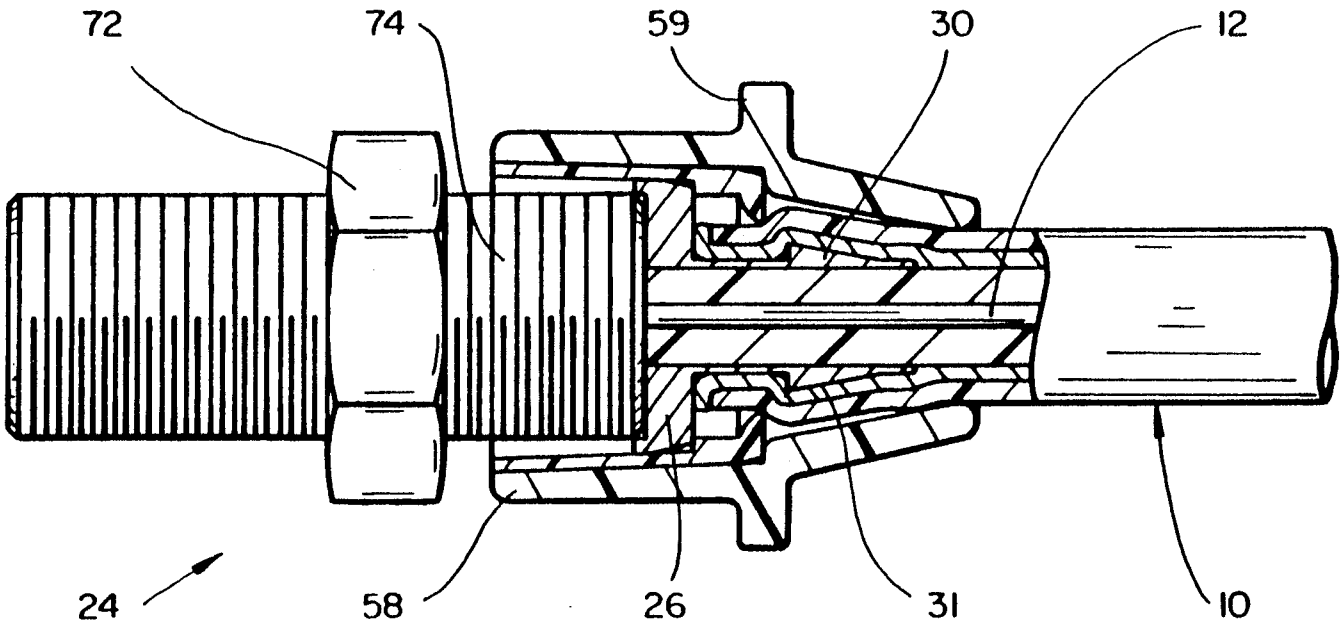
FIG. 7 shows the installed connector assembly mounted on a receptacle or jack with the outer shell pushed forward to lock the connector in place on the receptacle.

In FIG. 6, the connector assembly 24 has been withdrawn from the tool 70 (which may now be discarded as spent, or retained for installation of another connector assembly 24). Then, with the outer shell in the slid back position as shown in FIG. 6, the connector 24 may be pushed onto a jack 72, as shown in FIG. 7. The exemplary jack 72, typically an "F" jack, may define an outer threaded surface against which the fingers 38 of the mandrel body 26 come into contact. The shallow thread 39 (if present on the inside surface of the collet structure 37) is pitched to mate with the threaded surface of the jack. The outer shell 58 is then slid forward to a position shown in FIG. 7 which simultaneously locks the fingers 38 against the threaded surface 74 and the outer jacket elements against the frustoconical surface 31 of the mandrel body 26. The connector 24 is now securely, yet removably, attached to the connector. Any tugging on the cable 10 will result in the connector 24 becoming dislodged from the jack 72 in preference to an unwanted separation of the connector 24 and the prepared cable end 11.

To remove the connector 24 from the jack 72, the outer shell 58 may be grasped between the fingers and rotated to facilitate loostening the connector from the jack. The shell 58 is then slid rearwardly, thereby releasing the fingers 38 and enabling ready removal of the connector assembly 24. An outer annular ring or a pair of opposed flanges 59 (FIGS. 2F and 2G) formed on the shell 58 provides a suitable thumb-finger gripping mechanism to enable rotatable and slideable movement of the shell 58 relative to the mandrel 26, cap 50 and cable 10 for installation and removal of the connector 24 to and from the jack 72.

Figure 8B:
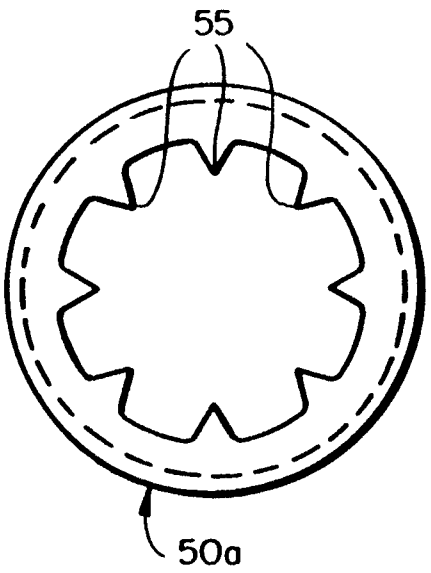
FIG. 8B illustrates the FIG. 8A tined snap-ring in rear elevation.
Figure 8A:
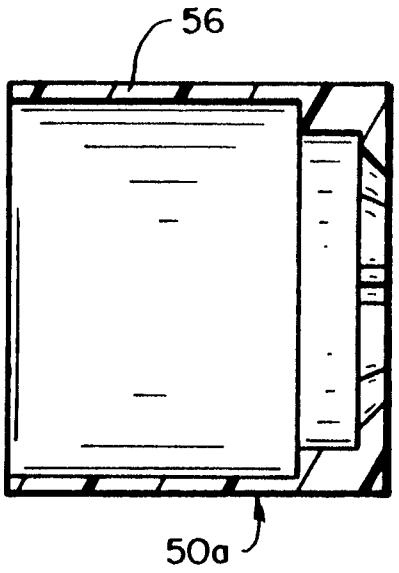
FIG. 8A illustrates in front view and axial section a tined, resiliently elastomeric portion of a snap-ring in accordance with the principles of the present invention.
Figure 9:
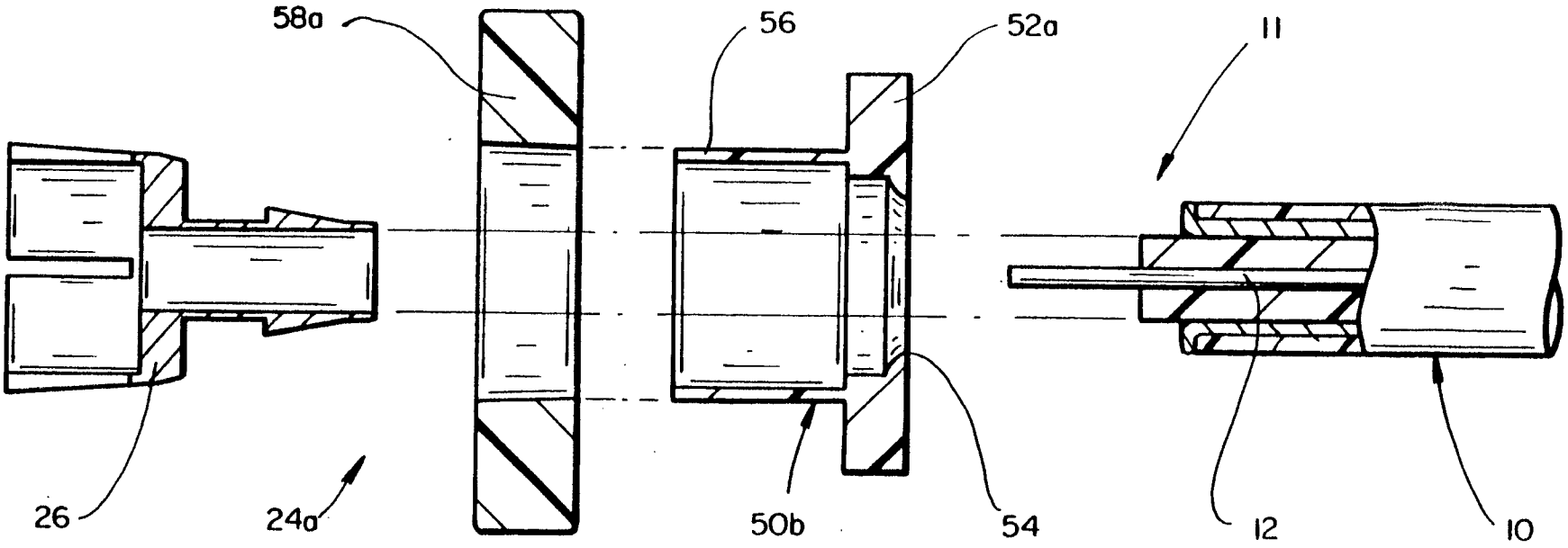
FIG. 9 shows in exploded view an alternative embodiment of connector in accordance with the principles of the present invention.
Figure 10:
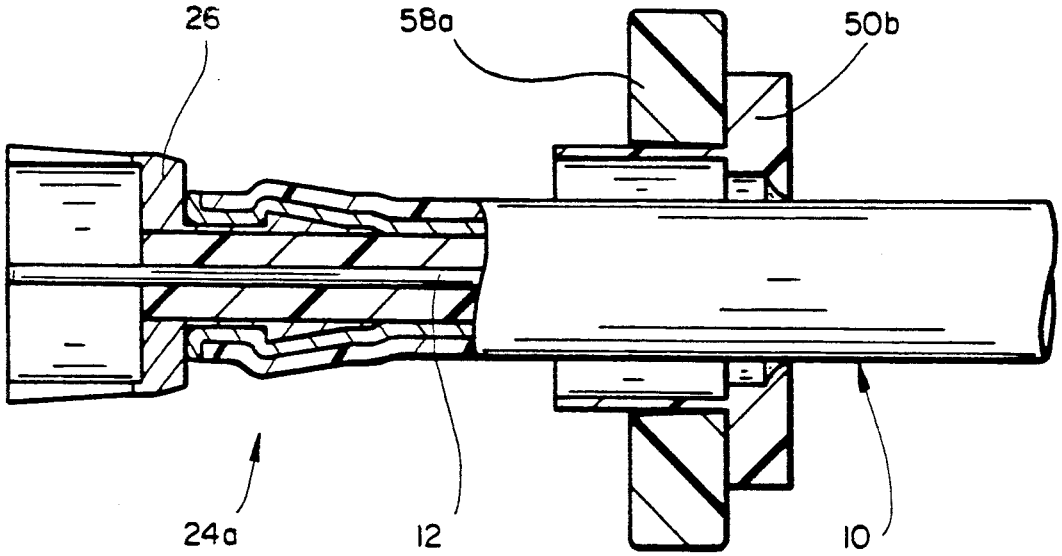
FIG. 10 shows the FIG. 9 mandrel element positioned onto the prepared cable end.
Figure 11:
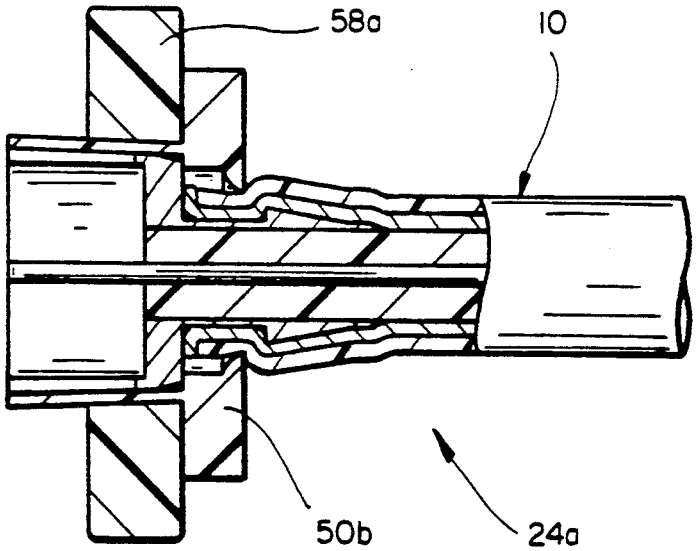
FIG. 11 shows the completed assembly of the FIG. 9 embodiment.
Figure 12:
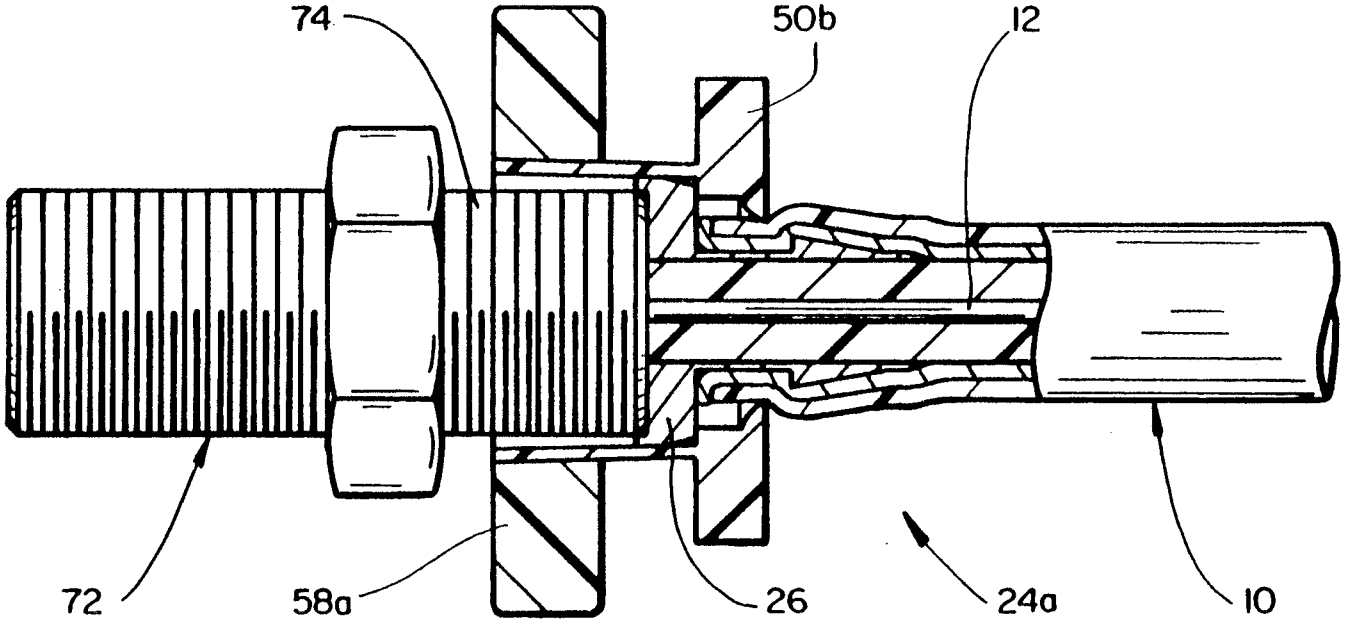
FIG. 12 shows the FIG. 9 embodiment engaging a connection receptacle.
Figure 13:
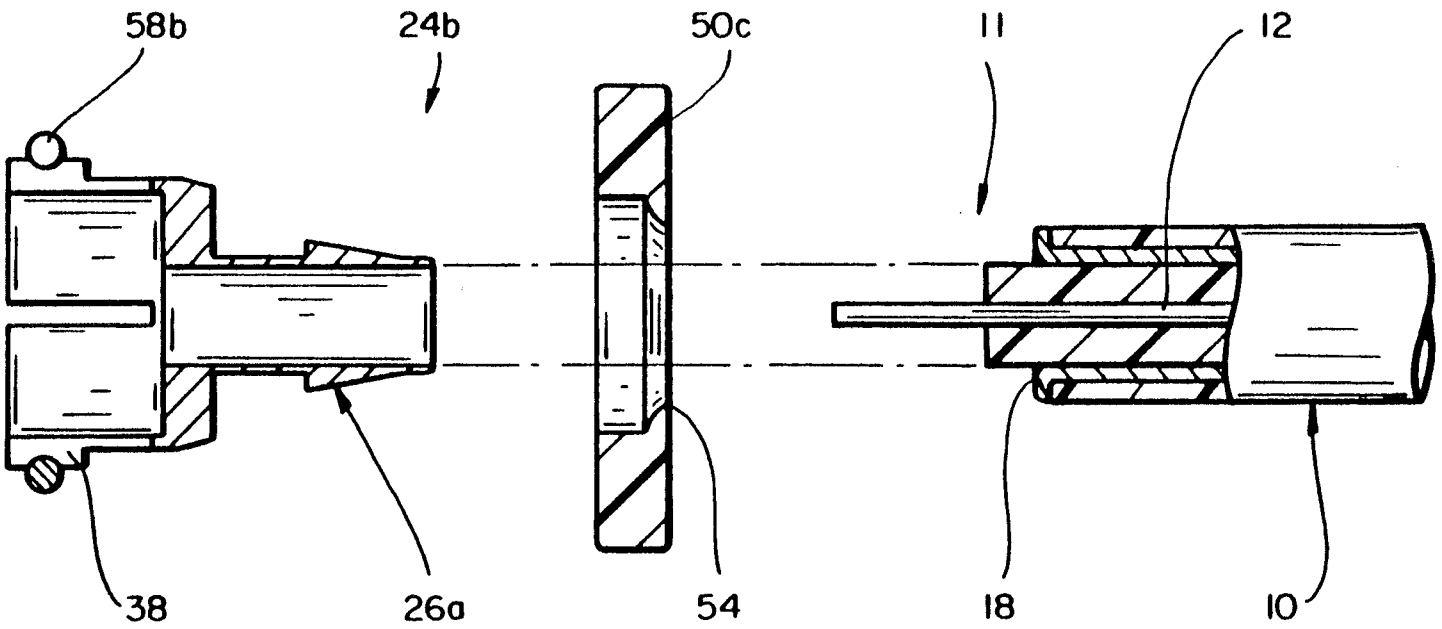
FIG. 13 illustrates yet another embodiment of the present invention in unassembled, axially exploded view.
Figure 14:
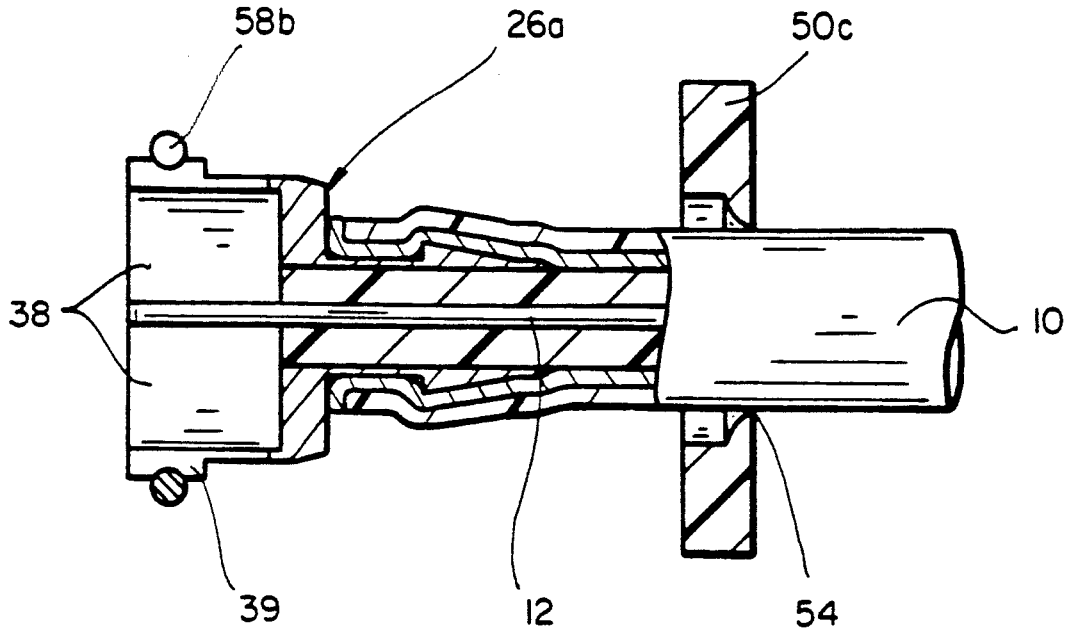
FIG. 14 shows the FIG. 13 connector mandrel mounted on a prepared end of a coaxial cable.
Figure 15:
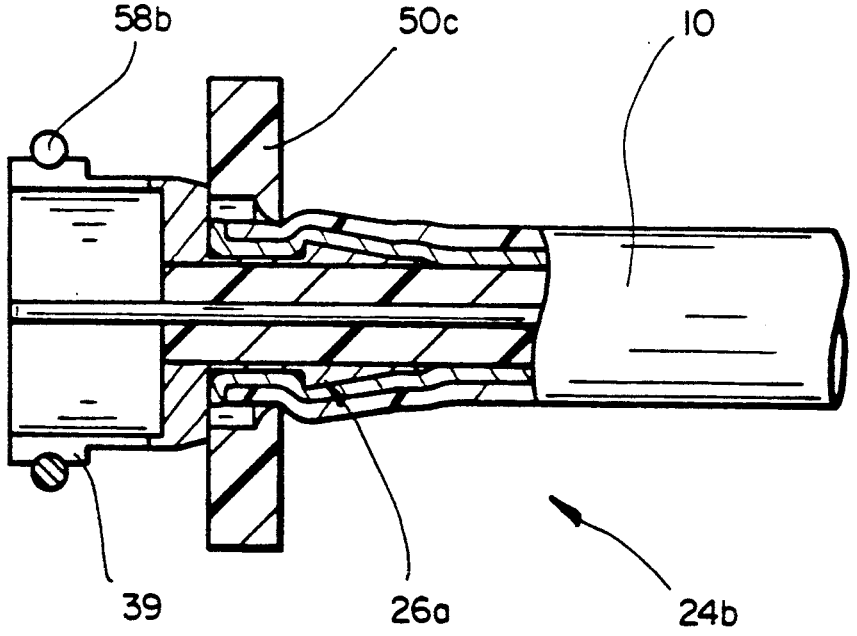
FIG. 15 shows completion of assembly of the FIG. 13 connector on the prepared end of the coaxial cable in accordance with the present invention.
Figure 16:
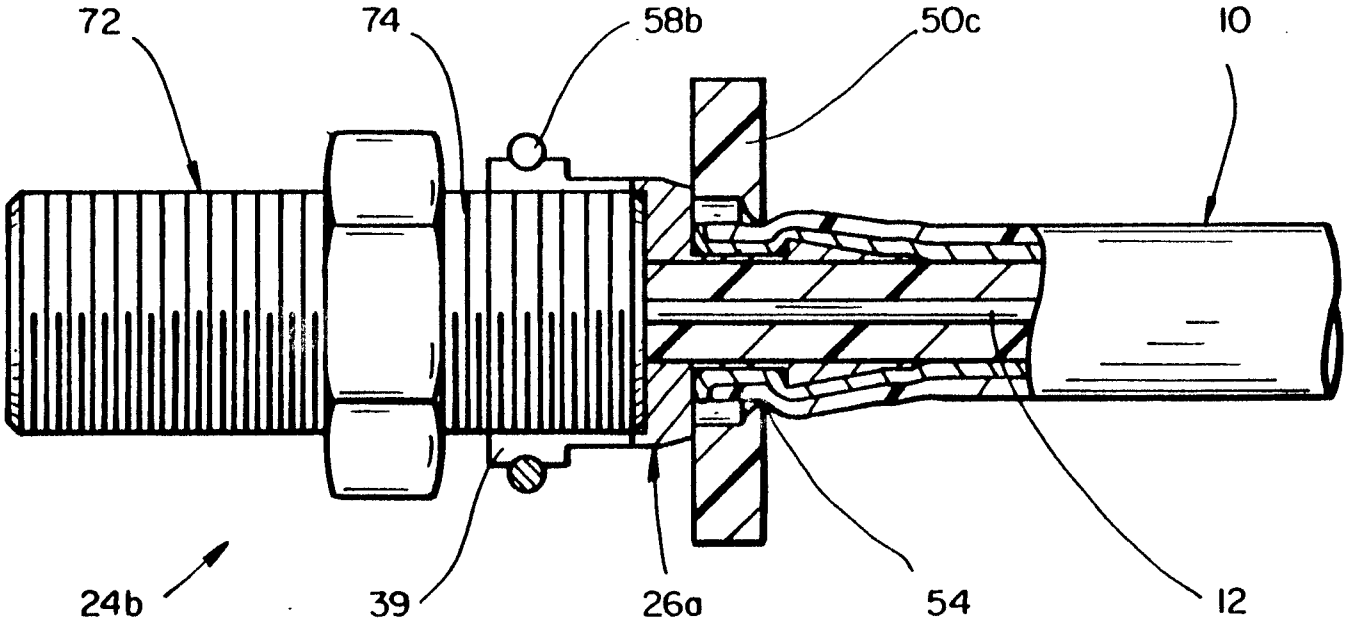
FIG. 16 shows the FIG. 13 connector in engagement with a connection receptacle.

FIG. 8 shows a cap **50*a* which is provided with a plurality of splines 55 in lieu of the continuous resilient portion 54. The operation of the cap 50*a* is similar with that described for the cap 50. However, the splines 55 dig into the outer plastic insulation 20 of the cable 10 to create a series of stress points or barbs which coact securely to retain and lock the braid and foil layers 18 against the knife-edge barb 33. In practice, the pointed tips of the splines 55 actually dig into the outer plastic coating 20**.

FIGS. 9–12 illustrate an alternative embodiment **24*a* of a connector embodying the principles of the present invention. In these figure, the same reference numerals are applied to the elements discussed in conjunction with FIGS. 1–7. A modified cap 50*b* includes a thickened radial portion 52*a* leading to the deformable annular edge 54. A disk 58*a* provides the finger closure function provided by the region 60 of the shell 58, previously described. The advantage of this embodiment 24*a* is that it provides a very flat and compact connector assembly. Also, there is very little drawback from stress relaxation of the thick disk, a problem sometimes encountered with the thinner outer shell 48 of the earlier described embodiments. One disadvantage with the connector 24*a* is that without the portion 64 of the outer shell, there is no additional reinforcement or support provided to the cable end at the vicinity of the frustoconical portion 30 of the mandrel body 26**.

FIGS. 13–16 illustrate yet another embodiment **24*b* of connector embodiment the principles of the present invention. In this embodiment 24*b*, the outer shell 58 has been replaced by a split ring 58*b* which is nested in a suitable band retention structure 39 formed around the periphery of the fingers 38 of the mandrel shell 26*a*. The cap is formed as a disk 50*c* which includes the elastomeric edge 54. An outer portion of the disk 50*c* enables the fingers to grasp the connector 24*b* for installation and removal from the jack 72. Because of the thickness of the disk 50*c*, there is very little stress relaxation, and once installed on the cable end over the mandrel body, the dick 50*c* will securely lock the cable end to the mandrel body 26. This embodiment 24*b* also has the drawback of not providing any structure for retaining the cable at the frustoconical portion of the mandrel body as is provided by the outer shell 58. Also, the split-ring 58*b* does not provide as secure an engagement with the jack as is achieved with the inside compression collet structure 37**.

Figure 17:
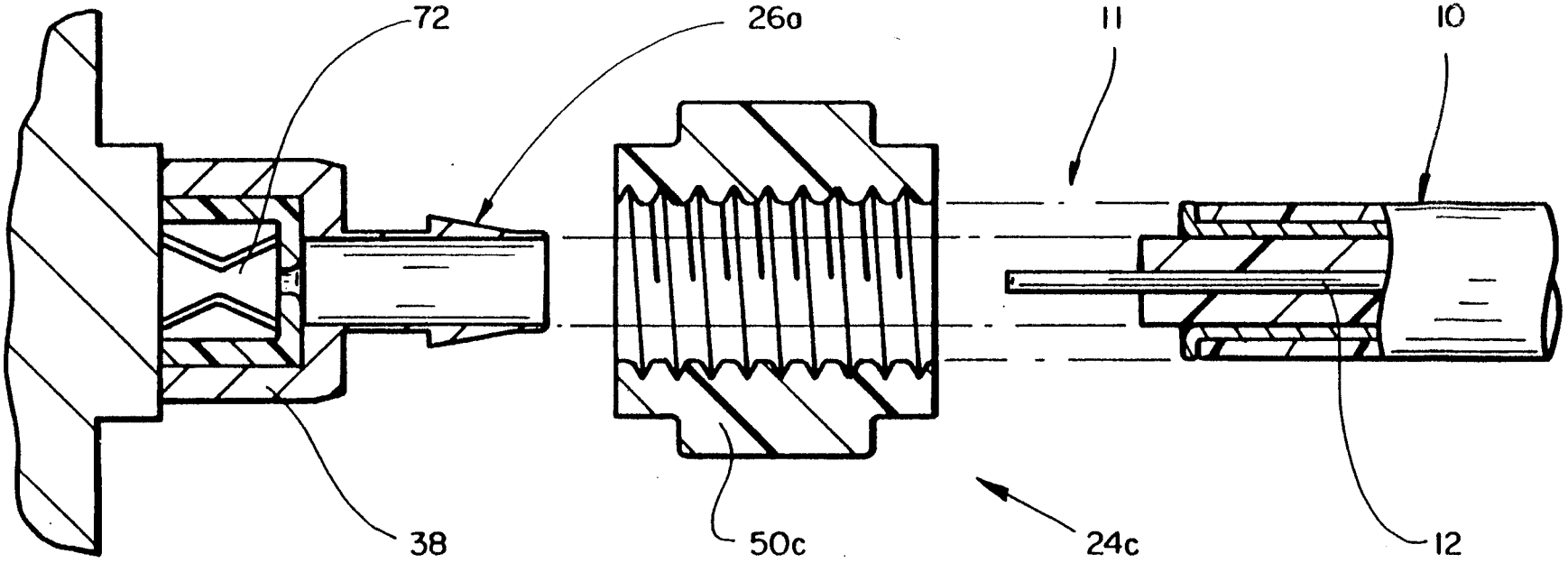
FIG. 17 shows yet a further embodiment of the present invention inn unassembled, axially exploded view.
Figure 18:
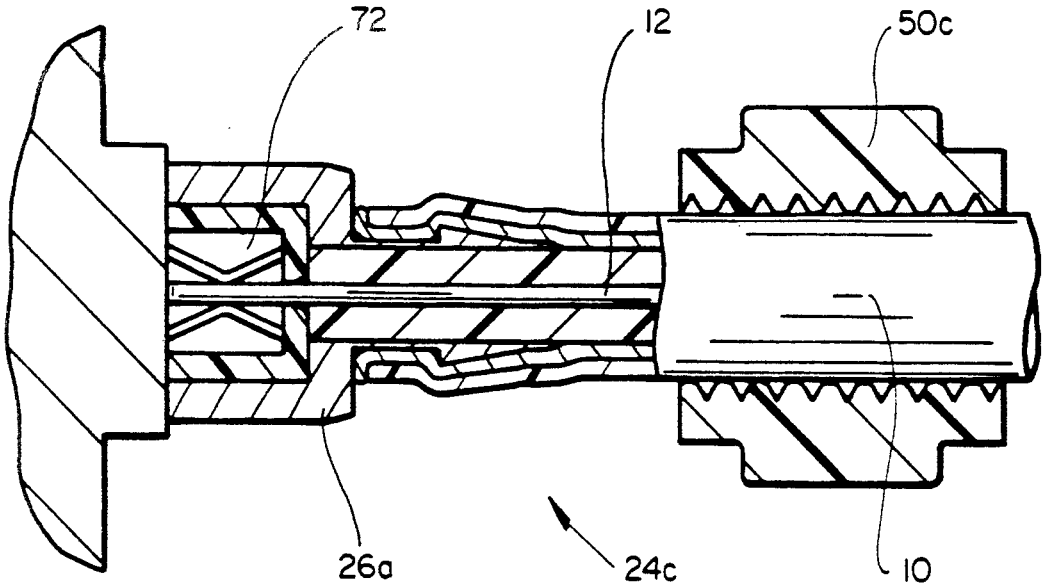
FIG. 18 shows the FIG. 17 mandrel mounted on a prepared end of a coaxial cable.
Figure 19:
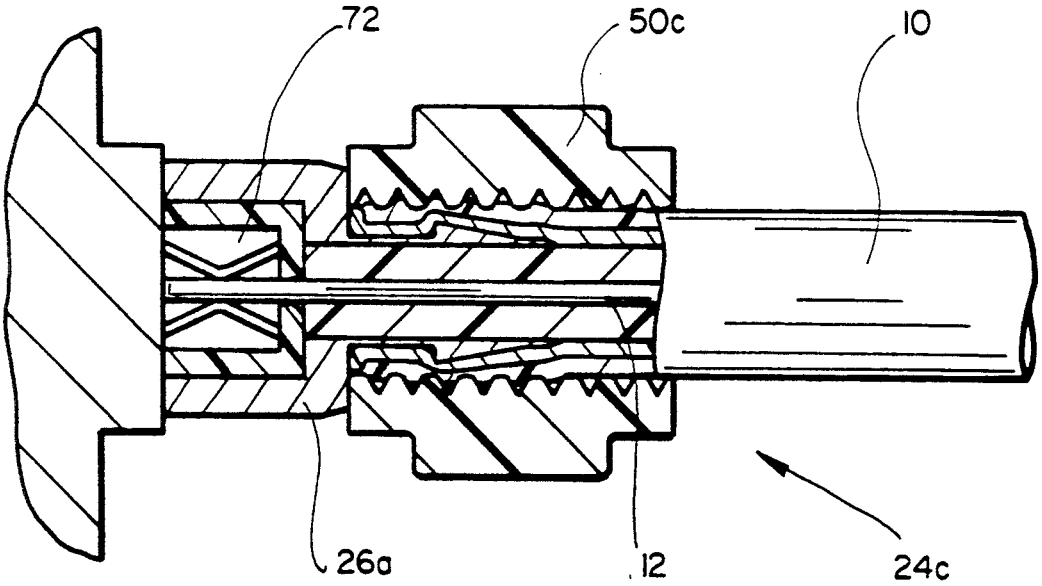
FIG. 19 shows completed assembly of the FIG. 17 mandrel on a prepared cable end and as mounted upon a mating connection receptacle.

FIGS. 17–19 illustrate a connector **24*c* also embodying the principles of the present invention. In this embodiment, only two elements are present, a slightly modified mandrel body 26*b*, and an elongated elastomeric threaded cap 50*c*. The fingers 38 of the mandrel body 26*b* are thickened for greater hoop strength. The threaded cap 50*c* is fit over the cable 10. The cable end 11 is then installed on the mandrel body 26*b*, and the cap 50*c* is then threaded onto the mandrel-cable arrangement as shown in FIG. 19, thereby securing the cable end 11 to the mandrel body 26*b***.

Figure 22:
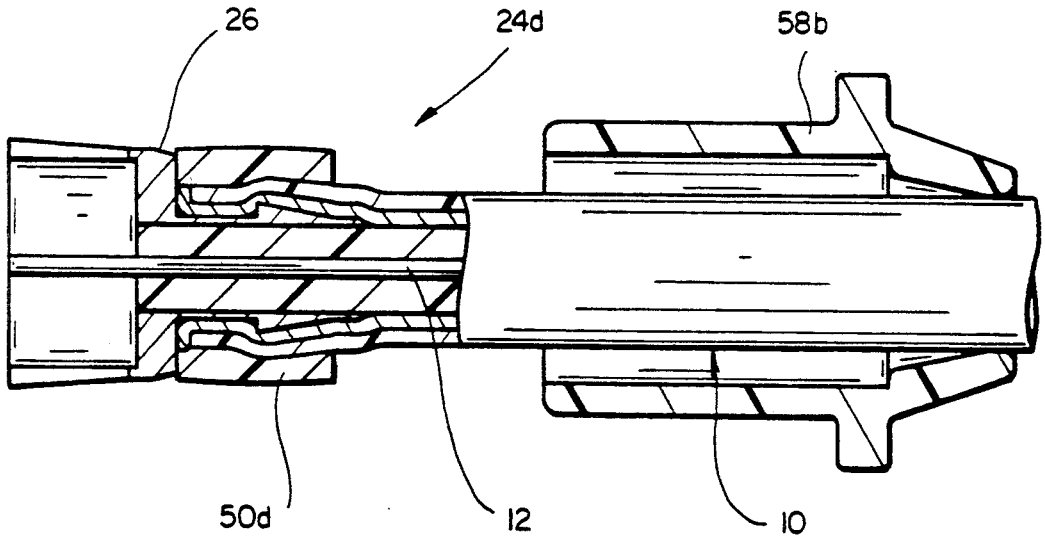
FIG. 22 shows placement of a resiliently elastomeric band over the FIG. 20 mandrel.
Figure 23:
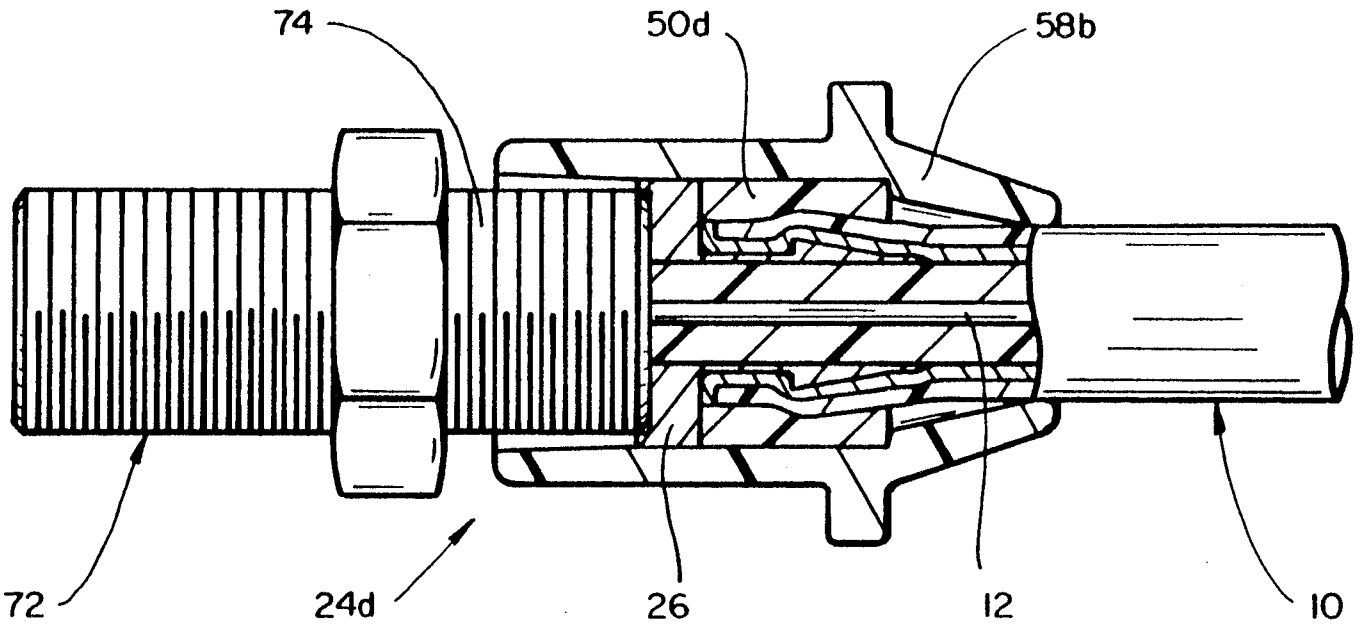
FIG. 23 shows the now fully assembled FIG. 20 embodiment engaging a connection receptacle.
Figure 24:
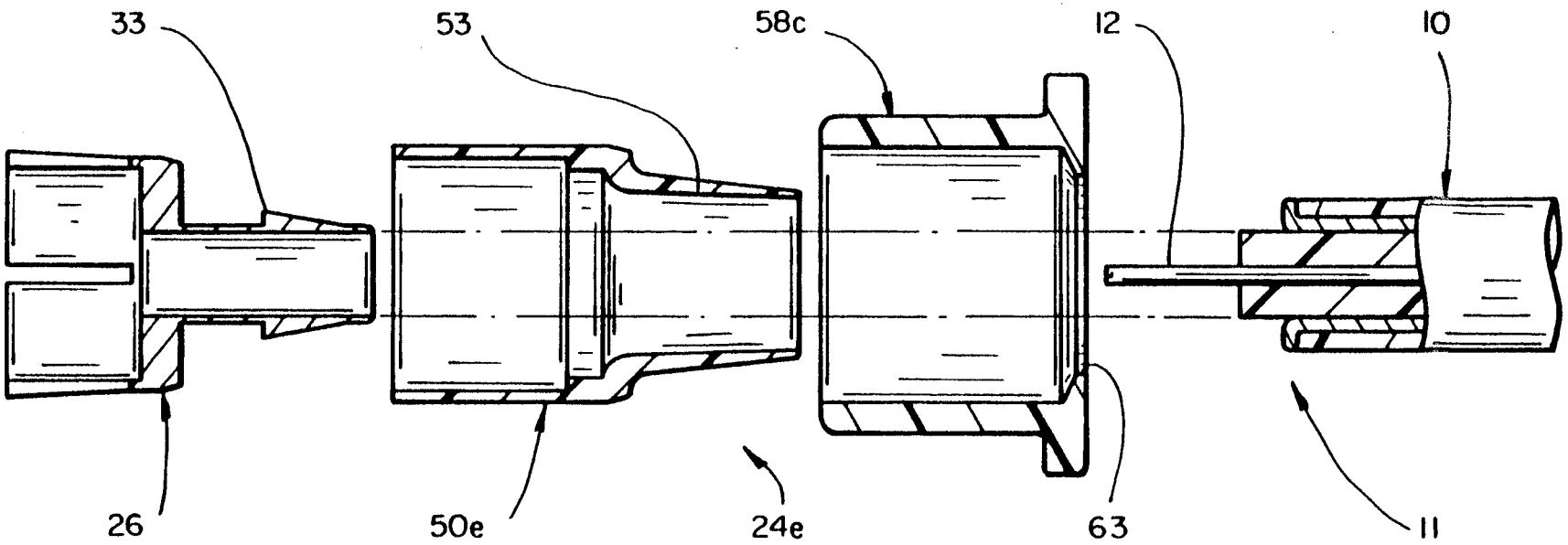
FIG. 24 shows yet another embodiment of the present invention in unassembled, axially exploded view.
Figure 25:
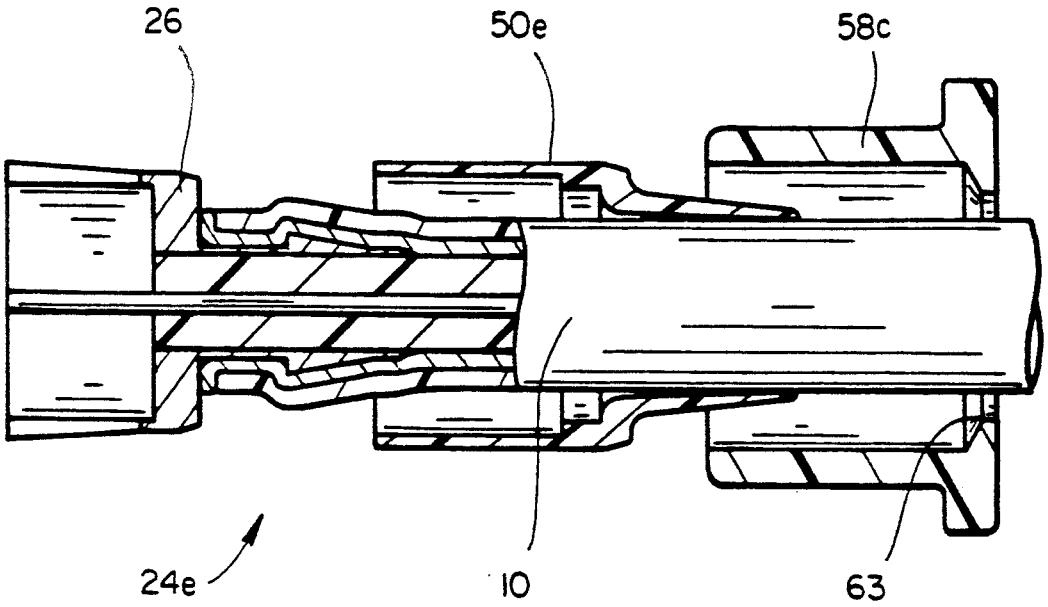
FIG. 25 shows placement of the FIG. 24 mandrel onto the prepared end of a coaxial cable.
Figure 26:
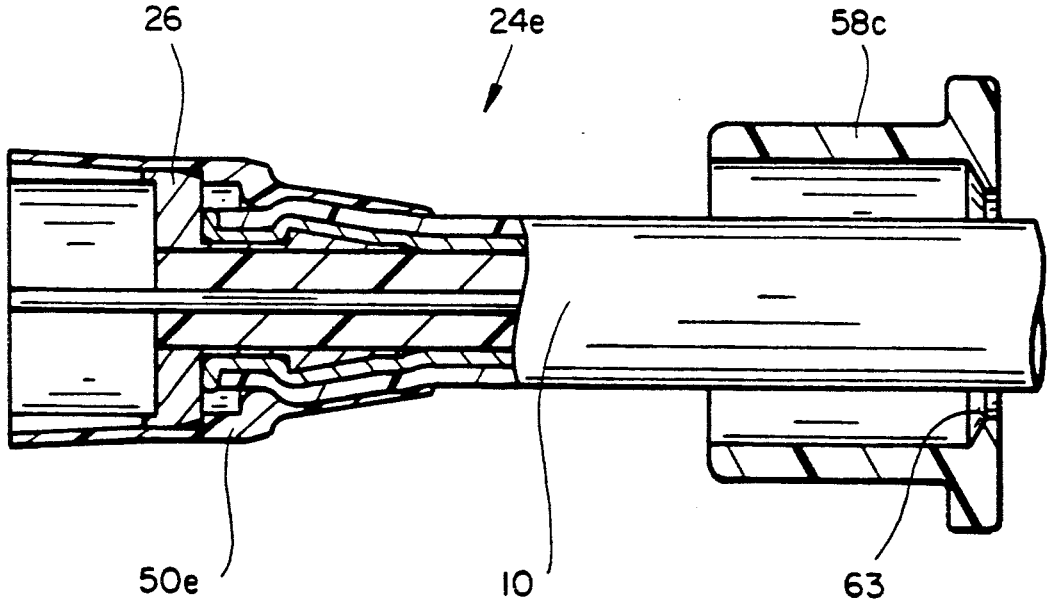
FIG. 26 shows placement of a snap member over the mandrel-cable assembly depicted in FIG. 25.

FIGS. 20–23 illustrate yet another embodiment **24*d* embodying the principles of the present invention. In this three-part embodiment 24*d*, the cap 50 is replaced by a cylinder 50*d* of elastomeric material. The cylinder 50*d* and an outer shell 58*b* are positioned onto the cable 10, and it is then forced onto the mandrel body 26 as with the connector 24. The shell 58*b* is then used to push the elastomeric cylinder 50*d* into a position overlying the knife edge 33 of the mandrel body 26, as shown in FIG. 22. Then, the connector 24*d* may be installed on the jack 72 and the shell 58*b* slid forward to lock the fingers 38 onto the outer threaded surface 74 of the jack, as shown in FIG. 23**.

Figure 27:
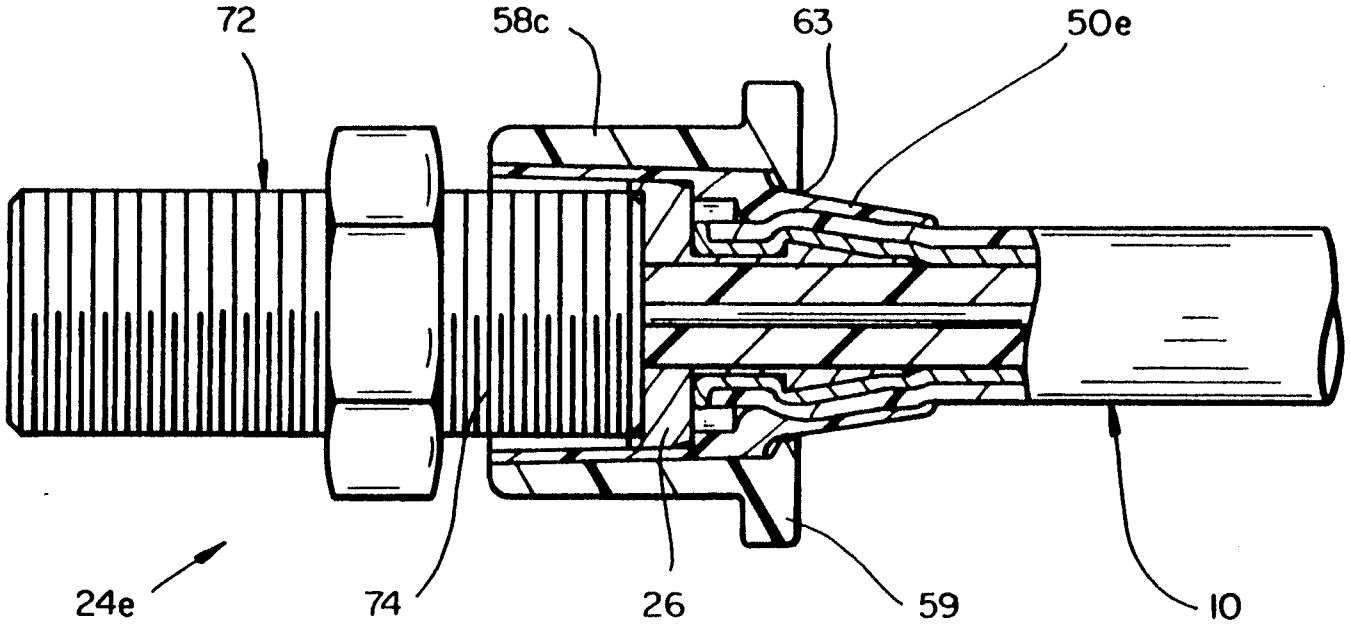
FIG. 27 shows the fully assembled FIG. 24 embodiment in electrical and mechanical attachment with a connection receptacle or jack.

The connector **24*e* shown in FIGS. 24–27 reveals yet another combination of cap 50*e* and outer shell 58*c* for use with the originally described mandrel body 26. In this embodiment of connector 24*e*, the cap 50*e* includes an elongated tail section 53 which is dimensioned and configured to overly the knife edge 33 of the mandrel body 26. When assembled and installed on the jack 72, the outer shell 58 is pushed to its forward position by grasping the outer flange 59. This action locks the fingers 38 onto the threaded outer surface 74 of the jack 72. A tapered annular edge 63** cooperates with the cap 50*e* to provide further compression to the cable jacket at the vicinity of the knife edge 33, as shown in FIG. 27.

The connector 24*f*, shown in FIGS. 28–32, includes a mandrel body 26*c* in which the frustoconical knife-blade edge 33 of the prior embodiments is replaced by a knife-blade helical thread or edge 33*a* projecting radially outwardly from the thinned tubular region 28. In one practical example, the thinned tubular region may be slightly frustoconical and have an average outside diameter of about 0.180 inch. The helical knife blade edge 33*a* has an apex which is approximately 0.210 inch and is formed as an acutely angled projection extending from the tubular region 28. The helical knife blade 33*a* is so shaped as to bite sufficiently into the fine aluminum strands of the outer conductor braid or aluminum foil to obtain a positive electrical contact with the foil and also to provide a positive mechanical securement therewith, without causing the strands to shear or break off.

An effective compromise between sharpness and dullness of the knife edge is to make it flat across for about two to three mils. A one mill flat is too sharp and will result in shearing the fine wire braid, while an eight mil radius at the edge has been found to be too dull with resultant slippage of the braid under tension. Ideally, the knife blade 33*a* should subject the braid wires to shear stresses without actually resulting in shearing them off. In practice the compromise is reached by considering sharpness of the knife edge 33*a* and the hardness of the material of which it is made.

The jig or tool 70*a* is modified to include teeth 80 which are sized and positioned to engage the slots 82 defined between the fingers 38 of the collet structure 37. An outer end portion 84 of the tool 70 may be provided with radial spokes or projections to facilitate gripping and impartation of rotational torque to the tool 70 to enable insertion of the threading mandrel 26*c* onto the prepared end of the cable 10. Rotational installation of the mandrel 26*c* onto the prepared cable end is illustrated diagrammatically in FIG. 30 by the arrow 84. The use of a helical knife-blade edge 33*a* on the mandrel 26*c* has been found to be particularly advantageous in order to facilitate ready installation of the assembly 24*f* onto the coaxial cable 10 at low ambient temperatures which cause substantial stiffness of the outer elastomer jacket 20 thereof. When the outer jacket 20 has stiffened due to lower ambient temperatures, it aids in causing the helical knife-blade edge 33*a* to bite into and positively engage the outer conductor braid/foil of the coaxial cable 10. Otherwise, the assembly of the connector assembly 24*f* is the same as described hereinabove for the assembly 24.

Figure 20:
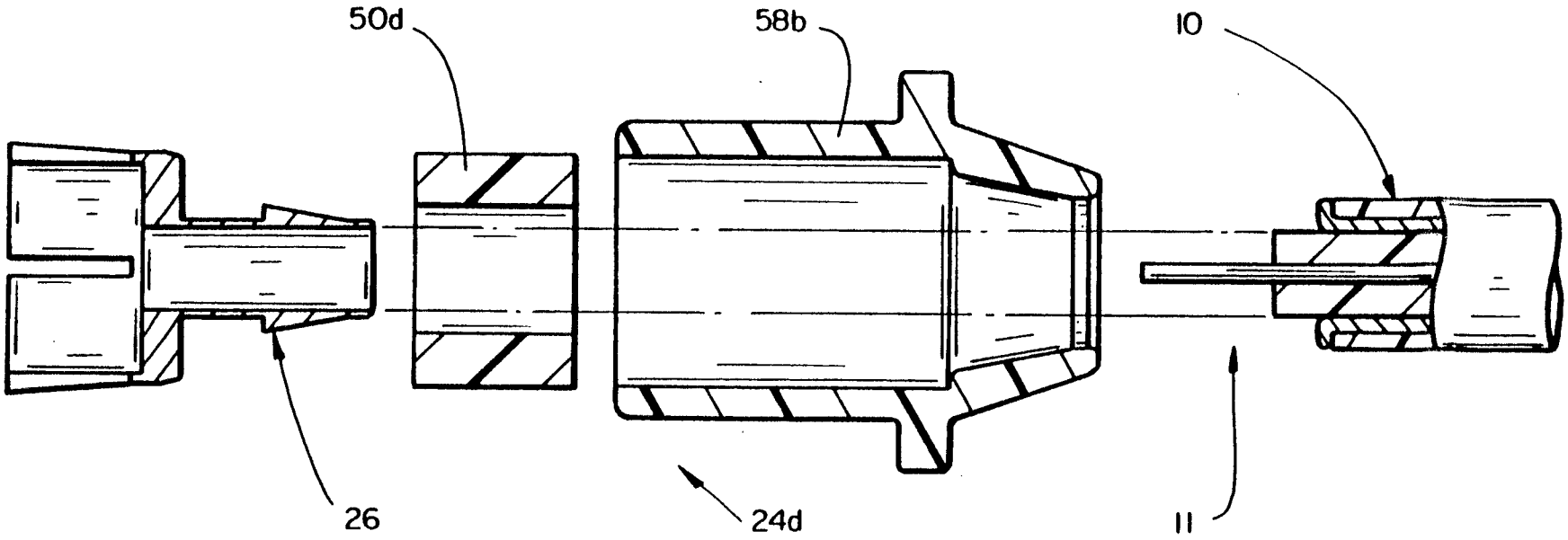
FIG. 20 shows another embodiment of the present invention in unassembled, axially exploded view.
Figure 21:
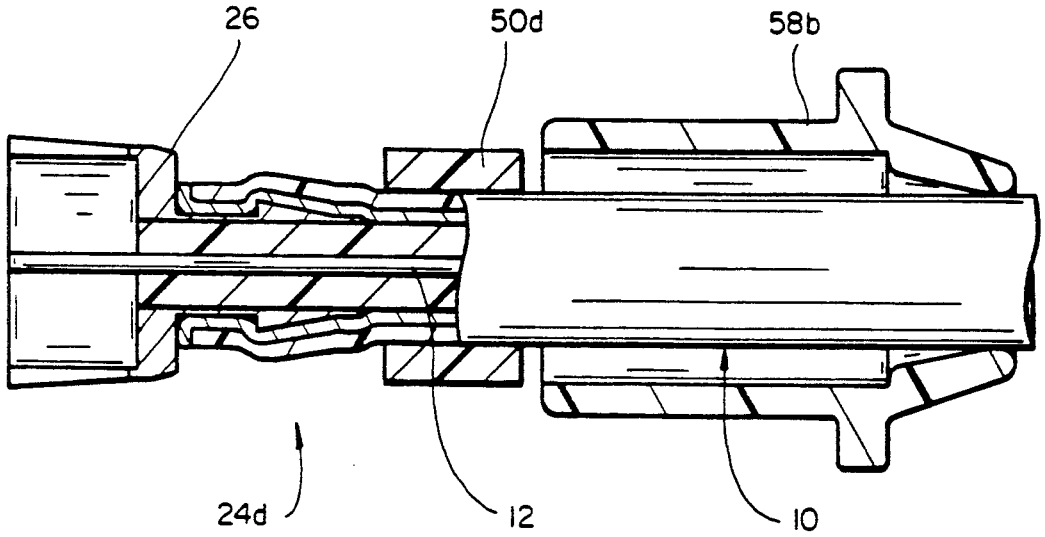
FIG. 21 shows partial assembly of the FIG. 20 mandrel being mounted on a prepared end of a coaxial cable.
Figure 28:
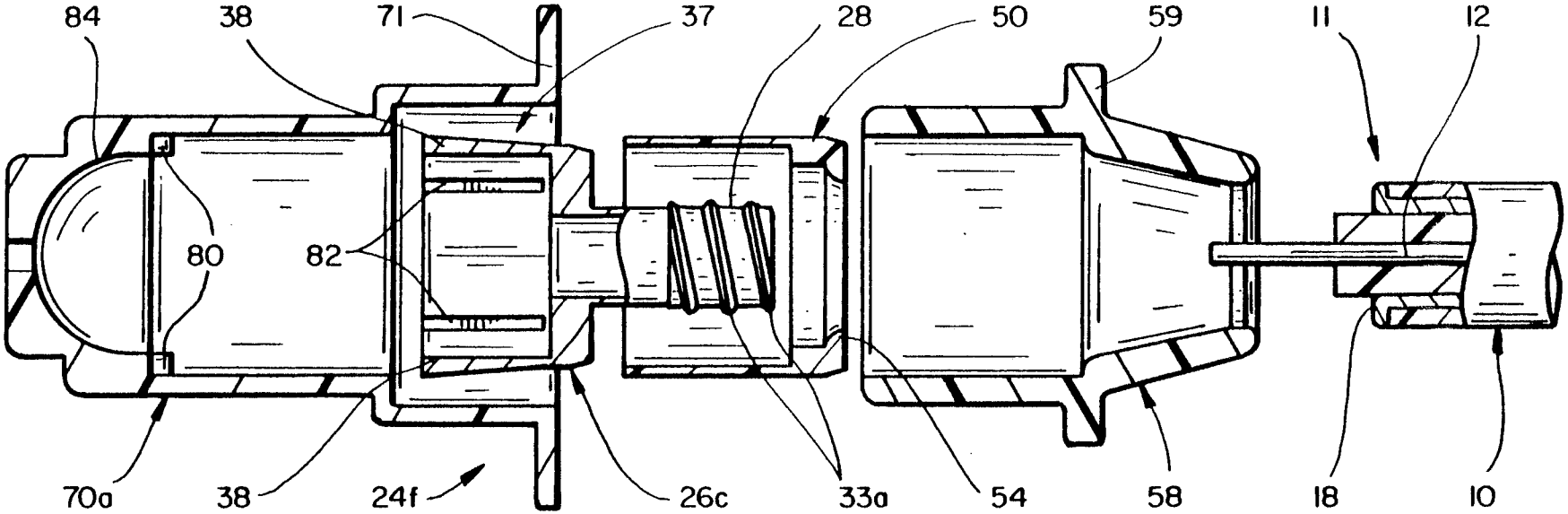
FIG. 28 illustrates yet another embodiment of a connector assembly in accordance with the present invention in unassembled, axially exploded view in elevation and partial section.
Figure 29:
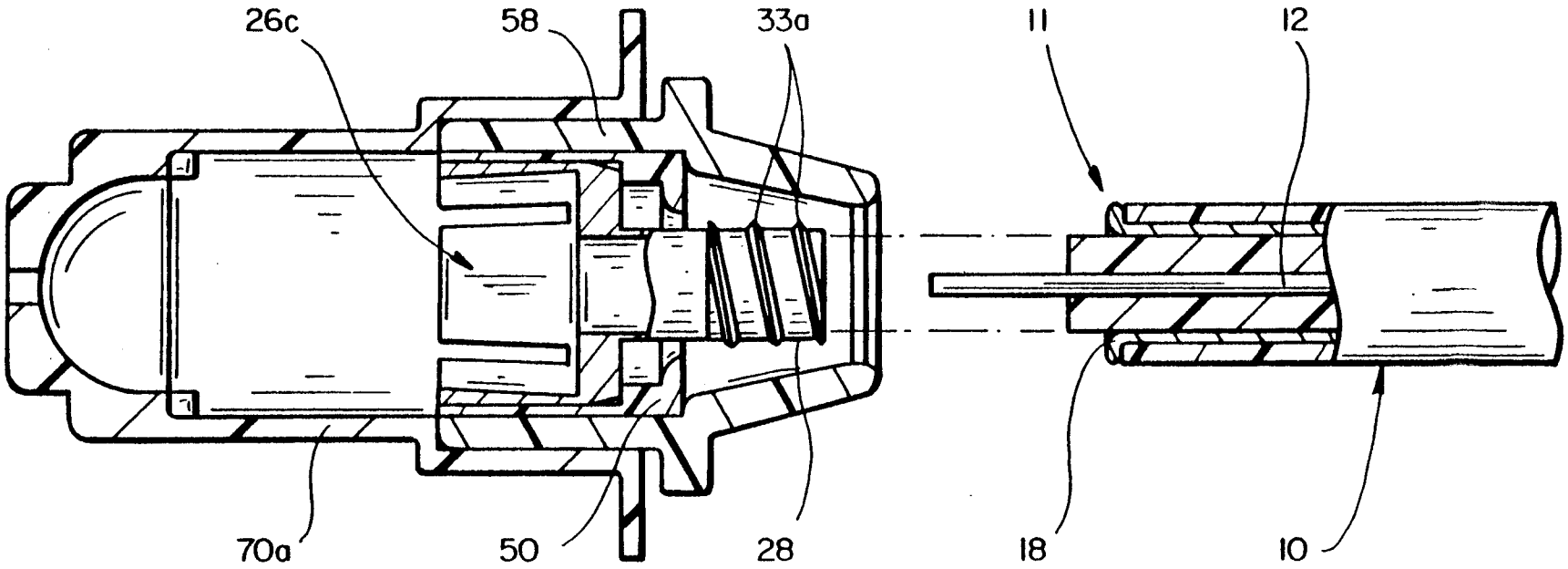
FIG. 29 shows the FIG. 28 embodiment nested in initial, unassembled arrangement incident to installation upon a prepared coaxial cable end. An expendable insertion tool provides a nest or container for holding and aligning the uninstalled component parts of the FIG. 28 connector assembly in axial alignment to facilitate assembly onto the prepared end of the coaxial cable.
Figure 30:
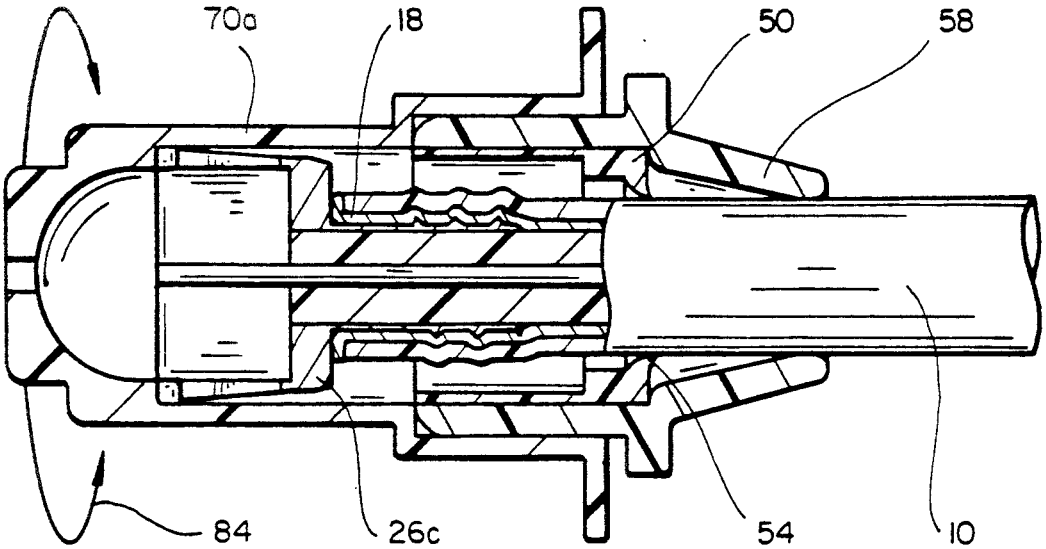
FIG. 30 illustrates installation by rotation of the FIG. 28 container and nested connector assembly elements onto the prepared coaxial cable cable end.
Figure 31:
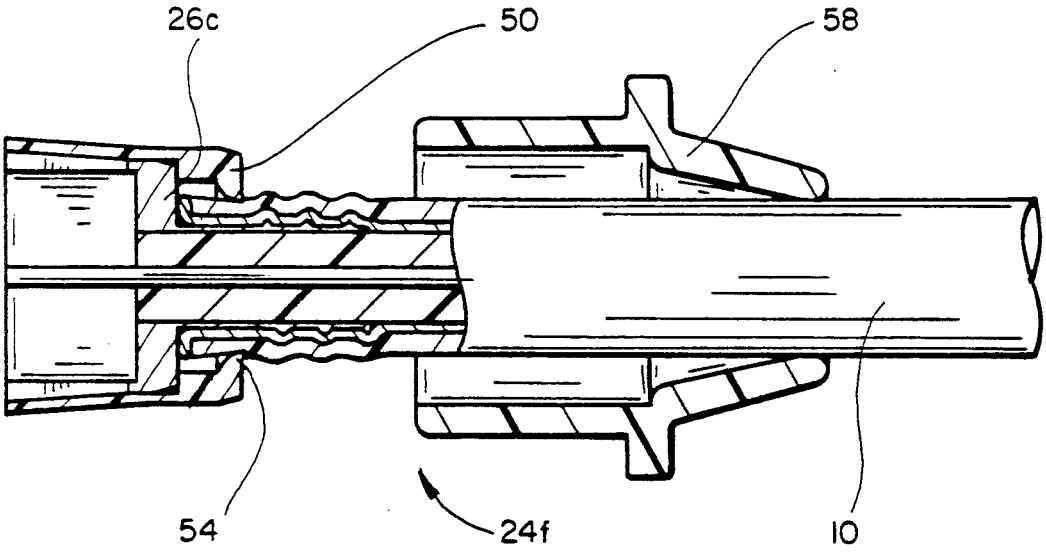
FIG. 31 illustrates the FIG. 28 connector assembly after the installation procedure of FIG. 30 has been completed.
Figure 32:
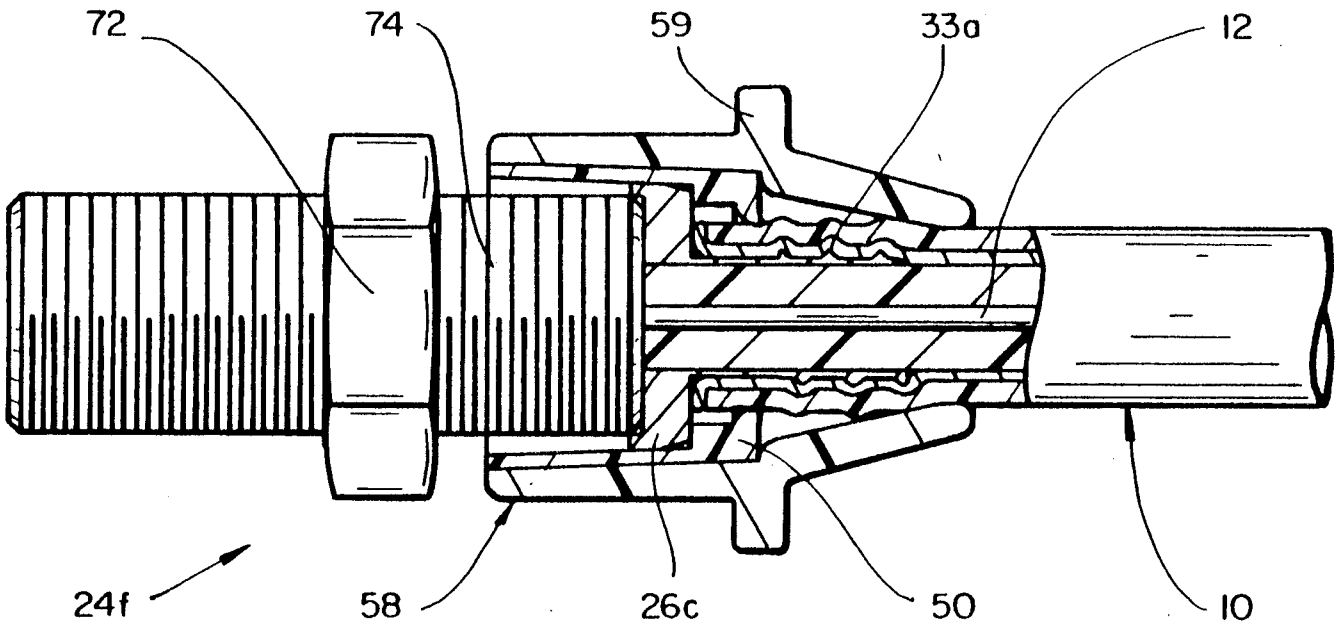
FIG. 32 illustrates the assembled FIG. 28 connector assembly in electrical and mechanical connection with a receptacle or jack.
Figure 33:
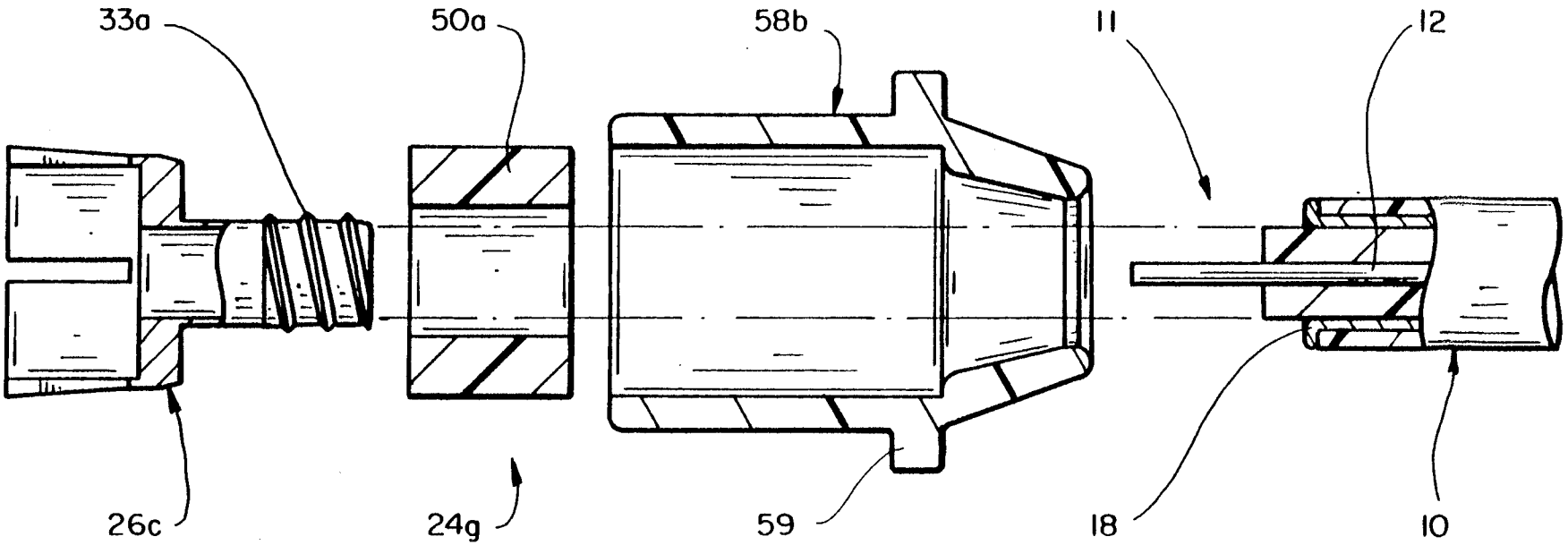
FIG. 33 shows yet another embodiment of connector assembly in accordance with the principles of the present invention.
Figure 34:
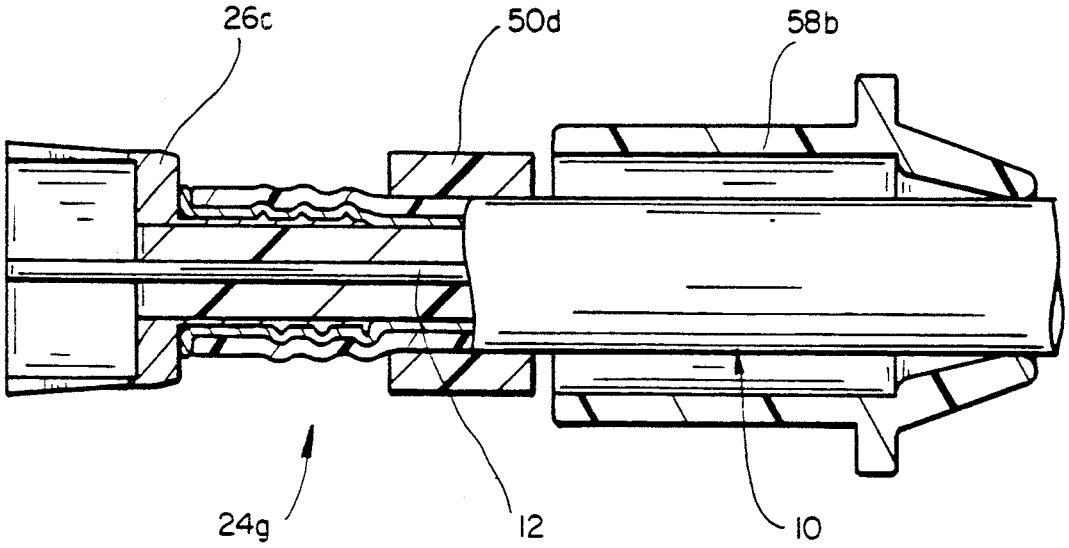
FIG. 34 illustrates the mounting of the mandrel portion of the FIG. 33 connector assembly onto the prepared cable end.
Figure 35:
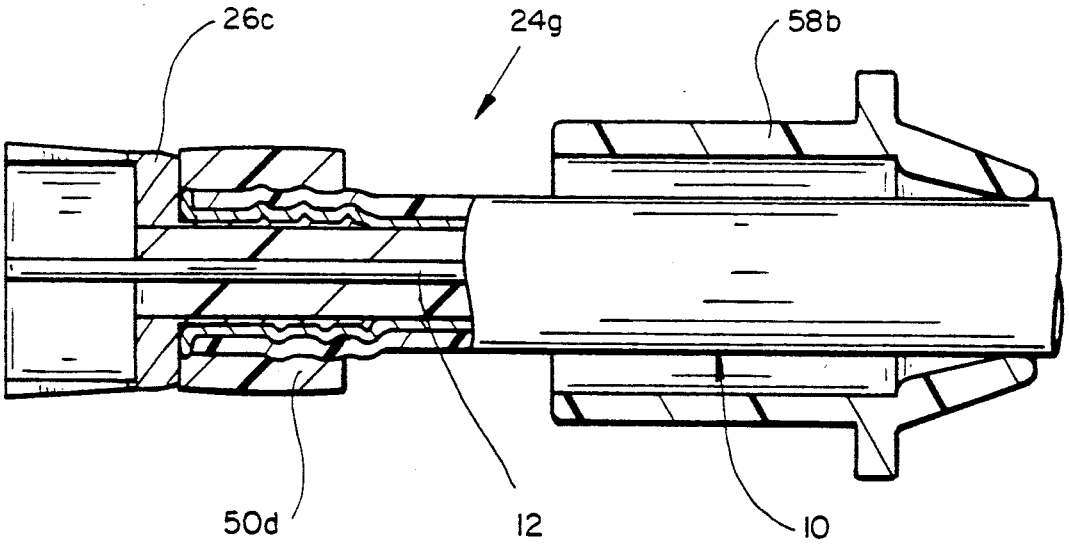
FIG. 35 illustrates the FIG. 33 connector assembly following placement of a resiliently elastomeric band over the FIG. 33 mandrel.
Figure 36:
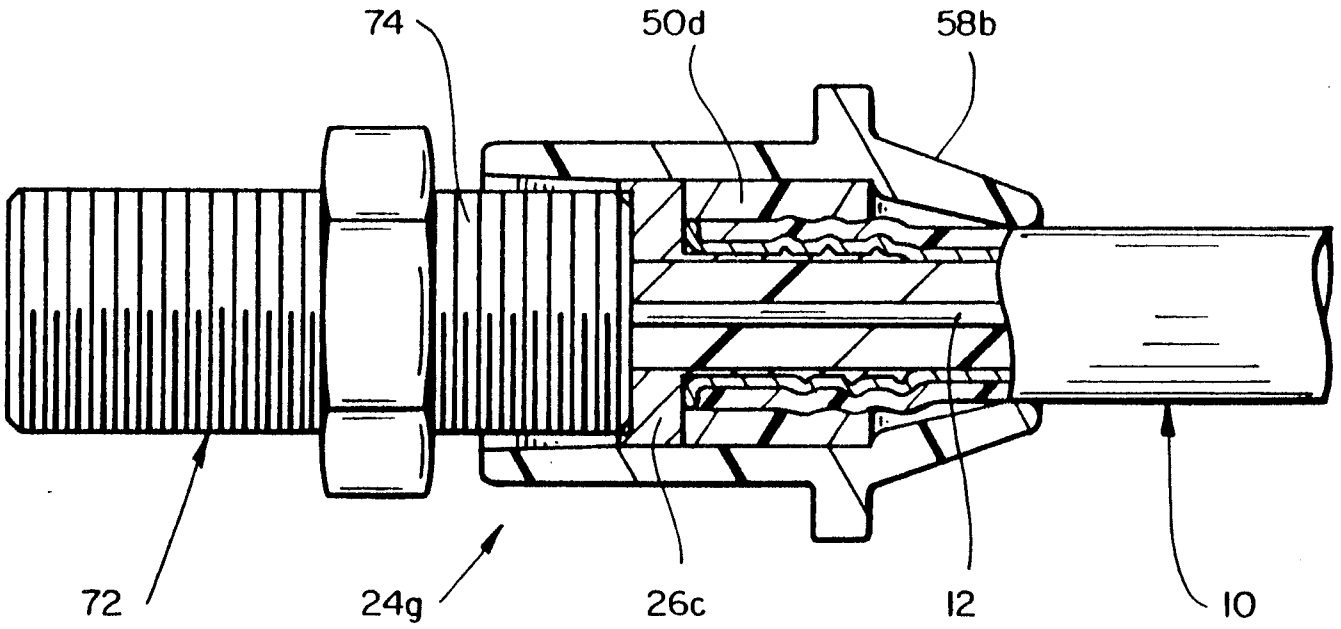
FIG. 36 illustrates the FIG. 33 connector assembly in electrical and mechanical attachment with a receptacle or jack.

The connector 24*g*, shown in FIGS. 3–36, combines the FIG. 28 helically threaded mandrel body 26*c* with the elastomeric cylinder 50*d* used in the FIG. 20 connector embodiment 24*d*. The mandrel 26*c* is threaded onto the prepared cable end as explained above in connection with the connector body 24*f* of FIG. 28, whereas, the elastomeric cylinder 50*d* is positioned as explained in conjunction with the FIG. 20 embodiment above.

Figure 37:
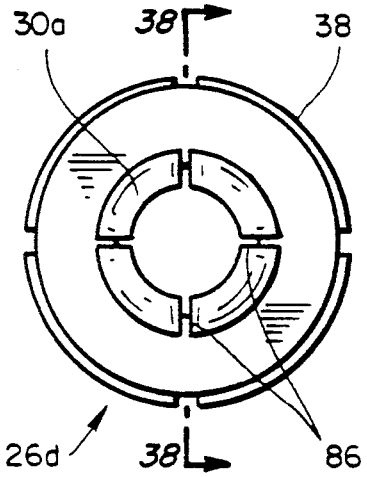
FIG. 37 comprises a cable end view in elevation of an embodiment of a colleting mandrel body which is radially expansive thereby to adapt and be used with coaxial cables having insulating cores of varying diameters within a predetermined range in accordance with principles of the present invention.
Figure 38:
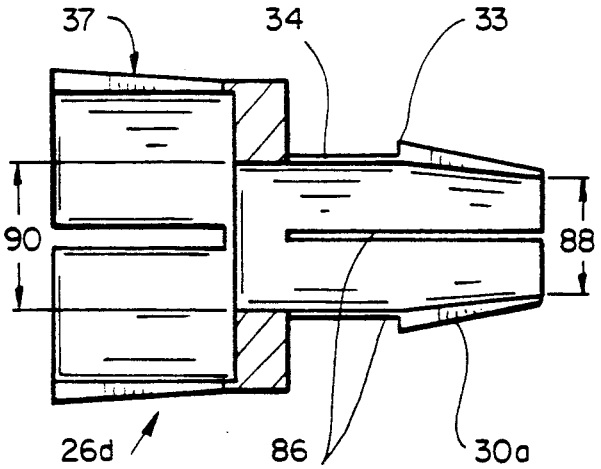
FIG. 38 is a side view in elevation and section of the FIG. 37 mandrel body, taken along the line 38 in FIG. 37.
Figure 39:
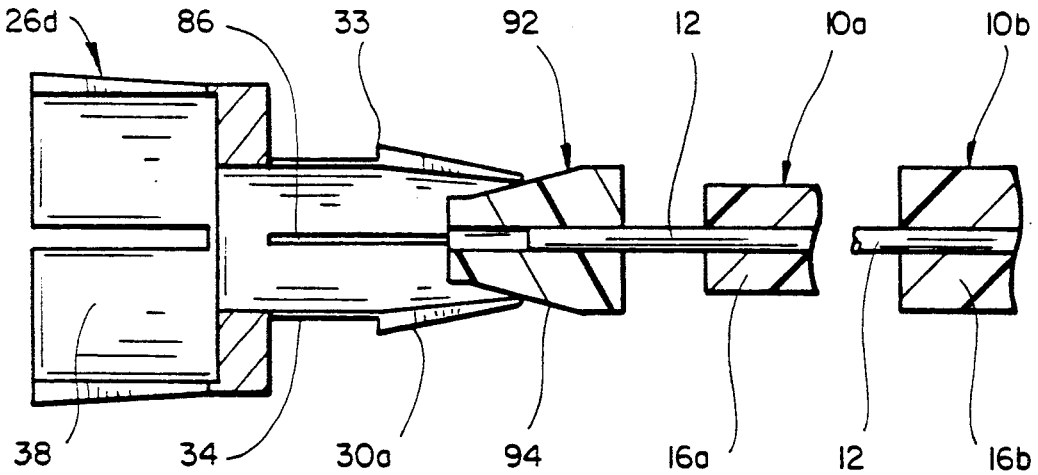
FIG. 39 is a somewhat diagrammatic view in side elevation of the FIG. 38 mandrel body and an expendable conical, ramp-shaped colleting guide member enabling installation of the FIG. 38 mandrel body onto two cables having inner cores of differing diameters.
Figure 40:
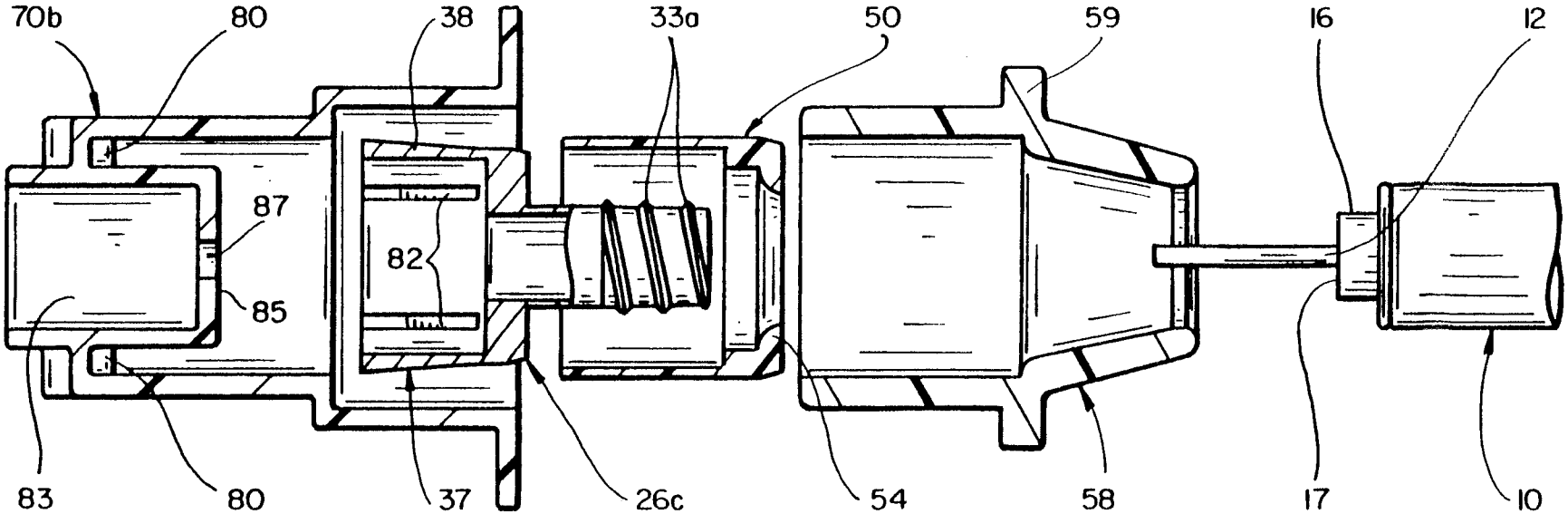
FIG. 40 is a view in partial section and axial explosion of the FIG. 28 coaxial cable connector embodiment showing a modified container/nesting tool.

The mandrel body 26*d*, illustrated in FIGS. 37–39, solves a problem otherwise associated with coaxial cables having different diameter foam cores within a predetermined size range. For example, an RG-59 cable 10*a* may have a diameter of about 0.145 inch for the core 16*a*, whereas an RG-6 cable 10*b* may have a diameter of about 0.185 for its core 16*b*. Both cables may be effectively terminated by a connector assembly including the mandrel body 26*d*. The body 26*d*, otherwise identical to the body 26, is formed to define e.g. four longitudinal slots 86. The slots 86 are very narrow, e.g. 0.10 inch, for example; and they extend from the cable end to the wall 36. An inside diameter, denoted by reference numeral 88, at the cable end corresponds generally to the outside diameter of the smallest cable core 16*a* within the size range to be accomodated, while an inside diameter, denoted by reference numeral 90, of the central bore of the tubular portion 34 of the mandrel body 26*d* is sized to accomodate the outside diameter of the largest cable core 16*b* within the predetermined size range. The frustoconical portion 30*a* of the mandrel body 26*d* is tapered toward the cable end diameter 88 on both the inside and outside thereof.

An expendable ramping tool 92 is provided for use in attaching the mandrel body 26*d* to the prepared cable end. The ramping tool 92, when positioned axially over the exposed central conductor 12 of the cable 10 to abut the core 16 causes the fingers formed by the slots 86 to expand radially as the mandrel body 26*d* is pushed toward the core 16. This radial expansion of the cable end of the mandrel body 26*d* positions it so that it will properly come into overlying engagement with the cable core, whether it be of a smaller diameter such as the core 16*a*, or of a larger diameter such as the core 16*b*. After the outside of the core 16 is engaged, the ramping tool is forced axially all the way through the tubular portion and into the region enclosed by the collet structure 37 where it may be readily removed and discarded by the installer.

While the frustoconical knife-blade edge 33 is illustrated in the FIG. 37–39 embodiment, it is clear that a helical knife blade edge 33*a* may also be used with equally successful results in this embodiment.

Referring now to FIGS. 40–43, the connector 24*f* depicted in FIGS. 28–32 and discussed in conjunction with those figures is again depicted. However, in FIGS. 40–43, a modified tool 70*b* illustrated in combination with the elements of the connector 24*f* and the cable 10. The tool 70*b* has a significant advantage in that it automatically prevents over-installation of the connector mandrel 26*c* into the prepared cable end.

In certain locations, low light levels make it most difficult or even impossible to gage whether the connector mandrel body 26*c* has been rotated onto the prepared cable end sufficiently. The consequence in practice has been that the mandrel body 26*c* has been threaded onto the cable end too far, with the result that the outer conductor braid and shield has become bunched up, leading to poor electrical and mechanical connection of the connector onto the cable end. The tool 70*b* is configured to prevent the mandrel body 26*c* from being rotated too far onto the prepared cable end.

Figure 41:
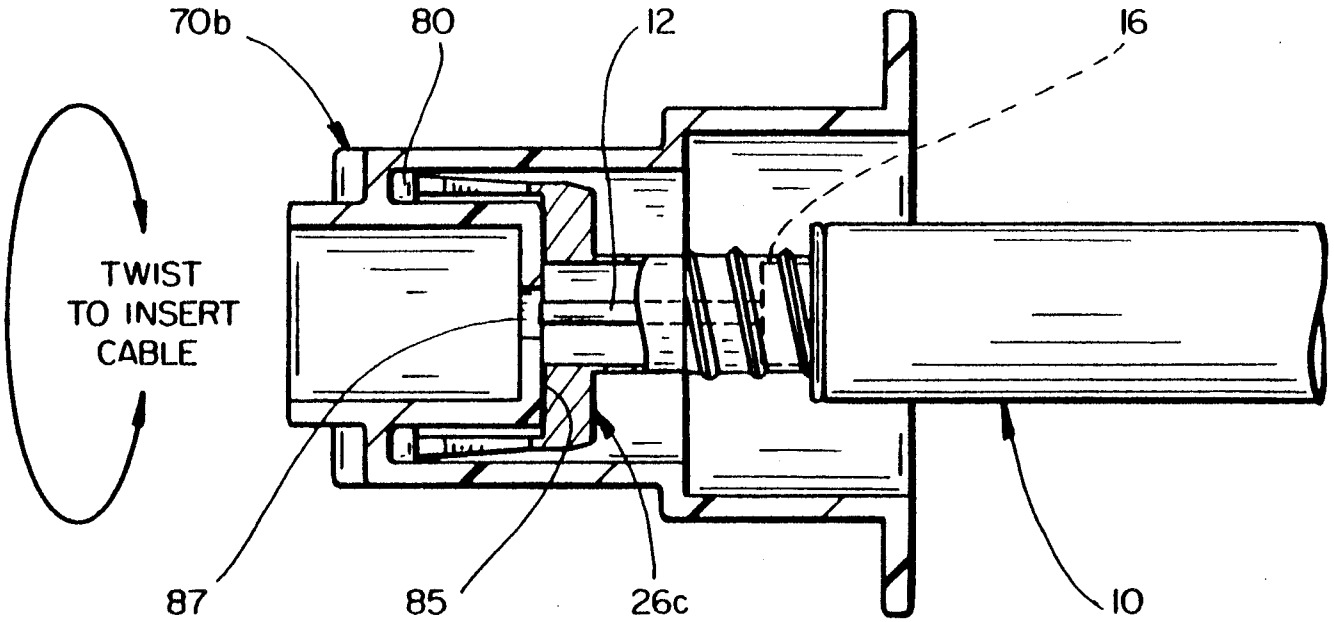
FIG. 41 illustrates placement of the coaxial cable connector elements within the container tool and threading of the assembly and tool over the prepared end of the coaxial cable.

In accordance with an aspect of the present invention, the tool 70 is formed with a hollow cylindrical plug region 83. The plug region 83 is concentric with the connector elements and with the prepared cable end. The plug region 83 defines an inner wall 85 which butts up against the mandrel body, as shown in FIG. 41. A central opening 87 is defined through the inner wall 85. Since the center conductor wire 12 has a diameter which typically ranges between 32 mils and 40 mils, the central opening 87 is sized to be about twice the largest wire diameter, or about 80 mils in diameter. This diameter is selected for two very important reasons: first, it is sufficiently smaller than the diameter of the dielectric core 16 of the cable 10 so that an end wall 17 thereof will come into contact with the inner wall 85 and thereafter dislodge the tool 70*b*. Secondly, the small diameter opening 87 serves as a gage to be sure that the center conductor 12 which is exposed at the prepared cable end is not bent. (If the exposed end of the inner conductor 12 is bent, damage will likely ensure to the center contact within a receptacle with which the assembled conductor and cable end will be used).

Figure 42:
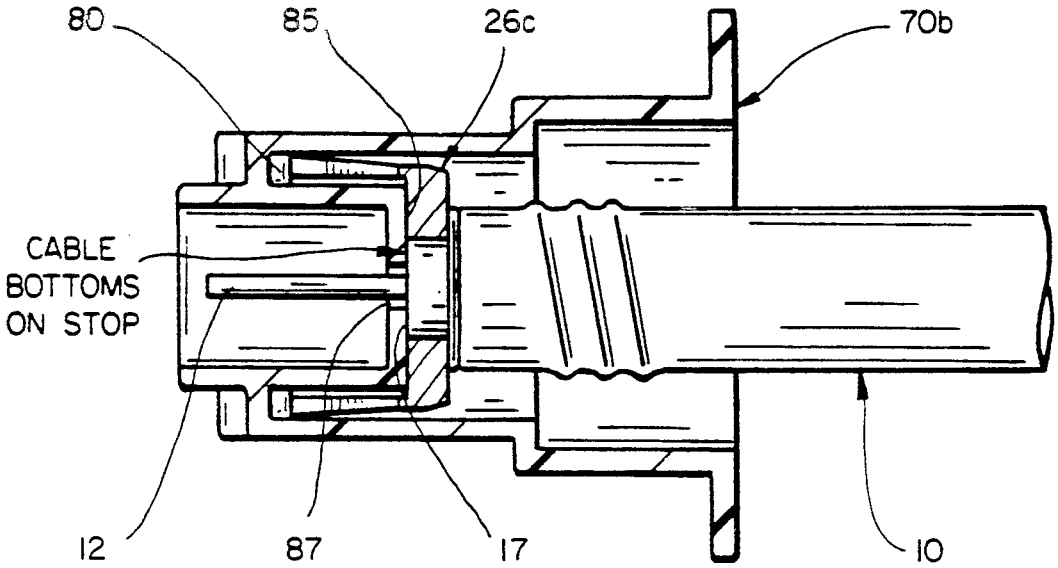
FIG. 42 illustrates initial engagement of the dielectric core of the cable with the plug end of the container tool.

As shown in FIG. 41 the cable 10 is just entering engagement with the mandrel body 26*c*. As the tool 70*b* is rotated, the teeth 80 thereof engage the slots 82 between the leaves 38 of the outer cap portion 37 of the mandrel body 26*c* and cause it to rotate with the rotation of the tool 70*b*. FIG. 42 illustrates a position at which the mandrel body 26*c* has been screwed onto the prepared end of the cable 10 to a position at which the end wall 17 of the dielectric has butted up against the inner wall 85 of the tool.

Figure 43:
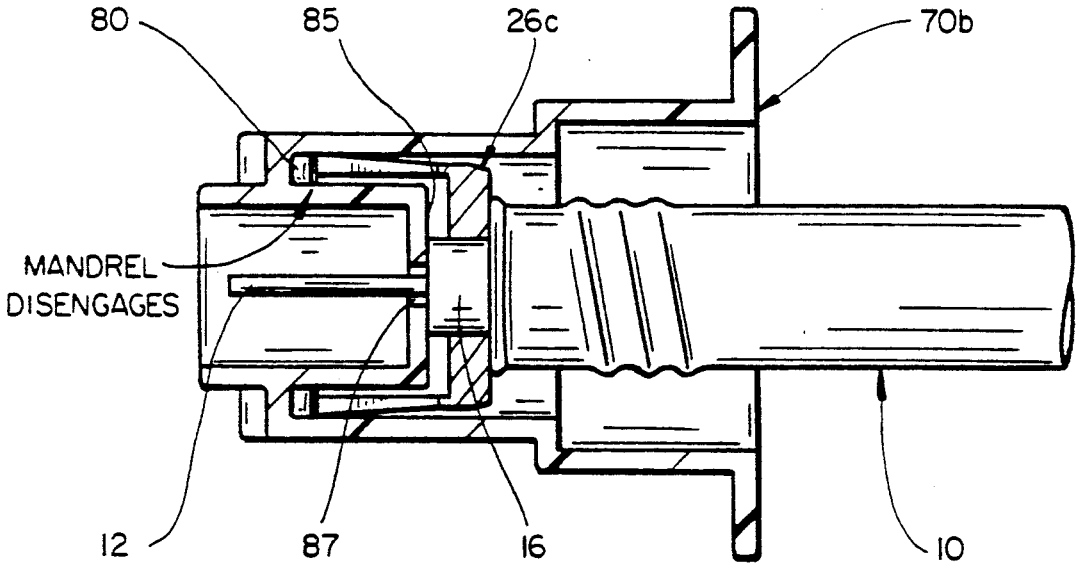
FIG. 43 illustrates the final position of the FIG. 40 assembly when the dielectric core of the cable has pushed the container tool to a point of disengagement between the teeth thereof and the slots of the mandrel cap.

As shown in FIG. 43, continued rotation of the tool 70*b* causes the mandrel body 26*c* to move rearwardly along the prepared cable end, and results in the dielectric core 26 projecting slightly beyond the end of the inner wall of the mandrel body. At this position, the inner wall 85 of the tool 70*b* is pushed away from the mandrel, causing the teeth 80 of the tool to become disengaged with the slots 82 between the cap fingers 38. At the point shown in FIG. 43, further rotation of the tool 70*b* does not cause any further rotation of the mandrel body 26*c* and thereby prevents it from becoming installed too far along the prepared cable end. Thus, with the tool 790*b*, the installer may rotate it relative to the cable 10 until automatic disengagement occurs, at which point the mandrel body 26*c* is properly installed to a correct length along the prepared cable end. While the same concept may be employed with a push-on tool 70 and annular barb 33, discussed previously, it is particularly advantageous to use the concept with the mandrel 26*c* having the helical thread barb 33*a*.

Statement of Industrial Applicability

The present invention realizes a three-part feedthrough connector assembly for a coaxial cable which may be readily installed upon a prepared end of a coaxial cable, and which efficiently and effectively clamps onto the prepared cable end to provide a secure electrical and mechanical securement to the outer conductor. A locking mechanism for locking the connector onto a jack or receptacle, and an installation tool, provide important aspects of the present invention.

While the instant invention has been described by reference to what is presently considered to be the most practical of embodiment and the best mode of practice thereof, it is to be understood that the invention may embody other widely varying forms without departing from he spirit of the invention. For example, the outwardly diverging shape of the inside compression collet 37 may be curved as opposed to frustoconical thereby to enable overstroke to account for the range in diametral tolerances of various jacks within a type with which the connector may be used. Also, alternatively, the outwardly divergent shape may be provided by the cap member 50. The presently preferred embodiments are presented herein by way of illustration only and should not be construed as limiting the present invention, the scope of which is more particularly set forth in the following claims.

What is claimed is:

1. A feedthrough coaxial cable connector for connecting to a prepared end of a coaxial cable having an exposed solid-wire central conductor, the connector comprising:

a tubular mandrel body of conductive material dimensioned to be pressed between a dielectric core and an outer conductor of the prepared end of the cable, the mandrel body including a cable engagement surface portion defining a projecting knife edge extending therearound for engaging an outer conductor of the coaxial cable, said cable engagement surface comprises a tubular structure including a helix projecting upwardly from the structure, the helix defining an acute angle and providing the projecting knife edge, a tubular shank portion extending from the cable engagement surface portion of the radial wall portion, and a receptacle engagement portion coaxial extending forwardly from the radial wall portion and coaxially disposed about the exposed central conductor and dimensioned to slide into and contact in close fitting friction engagement an outer surface of a receptacle means with which the connector makes in use, and radial compression means for compressing the inside surface of the outer conductor of the coaxial cable over the knife edge of the cable engagement surface of the mandrel body in order to place the outer conductor into shear stress and without shearing the outer conductor, the compression means including a resiliently deformable elastomeric material.

2. The coaxial cable connector set forth in claim 1 wherein the projecting knife edge is formed with a flat at the apex thereof, the flat being approximately two to three mils in cross dimension.

3. The coaxial cable connector set forth in claim 2 wherein the radial compression means comprises a snap-ring dimensioned to fit tightly over the coaxial cable at the knife edge including a portion thereof comprised of the resiliently deformable elastomeric material which is radially extended by the frustoconical surface so as to snap lock the coaxial cable toward the annular edge portion thereby to cause the outer conductor to bend over and bear upon the annular knife-edge.

4. The coaxial cable connector set forth in claim 3 wherein the portion of the snap-ring forms a spline having teeth which bite into and thereby engage an outer insulation covering of the coaxial cable and thereby cause it to press the outer conductor against and cause it to bear upon the annular knife-edge.

5. The coaxial cable connector set forth in claim 1 wherein the receptacle engagement portion is dimensioned to diverge radially from the radial wall portion and further comprising slideable shell means disposed over at least the receptacle engagement portion of the mandrel body, slideably positionable generally away from a connector end facing the outer surface of the receptacle to enable the receptacle engagement portion of the connector to slide freely over the outer surface of the receptacle, the slideable shell means being slidably positionable toward the connector end so as to radially compress the radially diverging receptacle engagement portion against the outer surface of the receptacle and thereby lock the connector thereto.

6. The coaxial cable connector means set forth in claim 5 wherein the slideable shell means further defines an inside frustoconical portion congruent with the frustoconical surface portion of the mandrel body for compressing a region of the coaxial cable outer conductor against the frustoconical surface portion of the mandrel body when the slideable shell means is slideably positioned over the mandrel body when the connector is locked onto the receptacle.

7. The coaxial cable connector set forth in claim 1 wherein the receptacle engagement portion is slotted longitudinally to form a slip ring for slideable engagement over the outer surface of the receptacle.

8. The coaxial cable connector set forth in claim 7 wherein the receptacle engagement portion includes plural slots and functions as a compression collet to lock onto the outer surface of the jack as a slideable shell means is positioned toward the connector end facing the receptacle.

9. The coaxial cable connector set forth in claim 3 wherein the snap ring includes a cap portion for fitting snugly over the receptacle engagement portion of the mandrel body thereby to provide additional hoop strength to the receptacle engagement portion.

10. The coaxial cable connector set forth in claim 9 wherein the receptacle engagement portion is dimensioned to diverge radially from the radial wall portion and further comprising slideable shell means disposed over at least the cap portion of the snap ring and the receptacle engagement portion of the mandrel body, the slideable shell means being slideably positionable generally away from a connector end facing the outer surface of the receptacle to enable the receptacle engagement portion of the connector to slide freely over the outer surface of the receptacle, the slideable shell means being slidably positionable toward the connector end so as to radially compress the radially diverging jack engagement portion against the outer surface of the receptacle and thereby lock the connector thereto.

11. The coaxial cable connector set forth in claim 10 wherein the slideable shell means is adapted to guide the snap ring into position over the coaxial cable end and mandrel body during installation of the connector onto the prepared end.

12. The coaxial cable connector set forth in claim 1 wherein the cable engagement surface portion has an interior bore which is generally frustoconically convergent toward the cable end, and further comprising a plurality of spaced apart longitudinal slots extending through the shank portion, thereby to define the cable engagement surface portion as a variable diameter collet for engaging a prepared cable ends having a dielectric core within a predetermined size range of varying core diameters.

13. The coaxial cable connector set forth in claim 12 further comprising expendable ramping means slidably positionable over the exposed central conductor of the cable for expanding the variable diameter collet as the mandrel body is positioned onto the prepared cable end.

14. A tubular mandrel body for a feedthrough coaxial cable connector, the mandrel body being formed of conductive material dimensioned to be positioned by hand between a dielectric core and an outer conductor of the prepared and of a coaxial cable, the mandrel body including a cable engagement surface portion defining a projecting knife edge extending therearound for engaging and outer conductor of the coaxial cable, said cable engagement surface portion comprises a tubular structure including a helix projecting upwardly from the structure, the helix defining an acute angle and thereby providing the projecting knife edge, a tubular shank portion extending from the cable engagement surface portion to a radial wall portion, and a jack engagement portion extending forwardly from the radial wall portion and coaxially disposed about the exposed central conductor and dimensioned to slide onto the contact in close fitting friction engagement an outer surface of a jack with which the connector mates in use.

15. The tubular mandrel body set forth in claim 14 wherein the knife edge being adapted to cooperate with the retention means of the cable connector slidably positionable over the cable end on which the mandrel body is mounted to become seated at the vicinity of the tubular shank portion.

16. The tubular mandrel body set forth in claim 14 wherein the jack engagement portion defines a shallow helical thread having a pitch to match a threaded outer surface of a jack type with which the connector is to be used after the jack engagement portion is pushed into engagement with the jack.

17. The tubular mandrel body set forth in claim 14 wherein the jack engagement portion is slotted longitudinally to form a slip ring for slideable engagement over the outer surface of the jack.

18. The tubular mandrel body set forth in claim 14 wherein the projecting knife edge is formed with a flat at the apex thereof, the flat being approximately two to three mils in cross dimension.

19. The tubular mandrel body set forth in claim 14 wherein the cable engagement surface portion has an interior bore which is generally frustoconically convergent toward the cable end, and further comprising a plurality of spaced apart longitudinal slots extending through the cable engagement surface portion and the tubular shank portion, thereby to define the cable engagement surface portion as a variable diameter collet for engaging a prepared cable ends having a dielectric core within a predetermined size range of varying core diameters.

20. The tubular mandrel body set forth in claim 14 formed by the process of die casting.

21. The tubular mandrel body set forth in claim 14 wherein the mandrel body is provided with a plating to improve lubricity characteristics.

22. The tubular mandrel body set forth in claim 14 wherein the jack engagement portion which i coaxial with the exposed central conductor includes a plurality of fingers which cooperatively define an inside collet structure for cooperation with a collet closure means of the connector which is slidably positionable over the collet structure toward the jack thereby to lock the collet structure onto a jack of a type intended for engagement with the connector.

23. The tubular mandrel body set forth in claim 22 wherein the plurality of fingers are formed by plural spaced apart radial slots extending longitudinally along the collet structure.

24. The tubular mandrel body set forth in claim 22 wherein the plurality of fingers are formed by plural slots formed by parallel cutting means operating upon the collet structure in a single pass.

25. The tubular mandrel body set forth in claim 22 wherein a cross-section of each finger defines a wall which is thicker at the opening of the collet structure than it is at the radial wall portion.

26. The tubular mandrel body set forth in claim 14 formed of a metal alloy selected from the group comprising copper, zinc and tin.

27. The tubular mandrel body set forth in claim 26 wherein the mandrel body is provided with a plating of material including tin to improve lubricity characteristics.

28. A kit of part for assembly into a feedthrough coaxial cable connector at a prepared end of a coaxial cable having an exposed solid-wire central conductor, the unassembled kit of parts comprising:

a tubular mandrel body of conductive material dimensioned to be pressed between a dielectric core and an outer conductor of the prepared end of the cable, the mandrel body including a cable engagement surface portion defining a projecting knife edge extending therearound, said cable engagement surface portion comprises a tubular structure including a helix projecting upwardly from the structure, the helix defining an acute angle and providing the projecting knife edge, a tubular shank portion extending from the cable engagement surface portion to a radial wall portion, and a jack engagement portion coaxial extending forwardly from the radial wall portion and coaxially disposed about the exposed central conductor and dimensioned to slide onto and contact in close fitting friction engagement an outer surface of a jack with which the connector makes in use, and radial compression means for compressing the inside surface of the outer conductor of the coaxial cable over the knife edge of the tubular mandrel body, the compression means including a resiliently deformable elastomeric material.

29. The kit of parts set forth in claim 28 wherein the jack engagement portion is slotted longitudinally to form a slip ring for slideable engagement over the outer surface of the jack.

30. The kit of parts set forth in claim 28 wherein the jack engagement portion defines a shallow helical thread having a pitch to match a threaded outer surface of a jack type with which the assembled connector is to be used after it is pushed onto the jack.

31. The kit of parts set forth in claim 28 wherein the projecting knife edge is formed with a flat at the apex thereof, the flat being approximately two to three mils in cross dimension.

32. The kit of parts set forth in claim 28 wherein the mandrel body is formed by the process of die casting.

33. The kit of parts set forth in claim 28 wherein the tubular mandrel body is provided with a plating to improve lubricity characteristics.

34. The kit of parts set forth in claim 28 wherein the radial compression means comprises a snap-ring dimensioned to fit tightly over the coaxial cable at the annular knife edge including a portion thereof comprised of the resiliently deformable elastomeric material which is radially extended by the frustoconical surface so as to snap lock the coaxial cable toward the annular wall portion thereby to cause the outer conductor to bend over and bear upon the knife edge in order to be subjected to shear stress without shearing of the outer conductor.

35. The kit of parts set forth in claim 34 wherein the portion of the snap-ring forms a spline having teeth which bite into and thereby engage an outer insulation covering of the coaxial cable when the connector is assembled and thereby press the outer conductor against and cause it to bear upon the knife edge.

36. The coaxial cable connector set forth in claim 35 wherein the snap ring includes a cap portion for fitting snugly over the jack engagement portion of the mandrel body upon assembly of the connector thereby to provide hoop strength to the jack engagement portion.

37. The kit of parts set forth in claim 28 wherein the jack engagement portion is dimensioned to diverge radially from the radial wall portion and further comprising slideable shell means for clamping engagement over at least the jack engagement portion of the mandrel body, the slidable shell means being slideably positionable generally away from a connector end facing the outer surface of the jack to enable the jack engagement portion of a connector assembled from the kit to slide freely over the outer surface of the jack, the slideable shell means being slidably positionable toward the connector end so as to radially compress the radially diverging jack engagement portion against the outer surface of the jack and thereby lock the assembled connector thereto.

38. The kit of parts set forth in claim 37 wherein the cable engagement surface portion of the tubular mandrel body comprises a rearwardly converging, generally frustoconical surface portion defining a shallow angle with respect to a longitudinal axis of the cable, a radially extending annular wall portion extending outwardly to the frustoconical surface portion for defining the knife edge generally as an annulus, and wherein the slideable shell means further defines an inside frustoconical portion congruent with the frustoconical surface portion of the mandrel body for compressing a region of the coaxial cable outer conductor against the frustoconical surface portion of the mandrel body when the slideable shell means is slideably positioned over the mandrel body.

39. The kit of parts set forth in claim 37 wherein the jack engagement portion includes plural slots and functions as a compression collet to lock onto the outer surface of the jack as the slideable shell means is positioned toward the connector end facing the jack.

40. The kit of parts set forth in claim 28 wherein the jack engagement portion i dimensioned to diverge radially from the second radial wall portion and further comprising slideable shell means disposed over at least the cap portion of the snap ring and the jack engagement portion of the mandrel body, the slideable shell means being slideably positionable generally away from a connector end facing the outer surface of the jack to enable the jack engagement portion of the assembled connector to slide freely over the outer surface of the jack, the slideable shell mean being slidably positionable toward the connector end so as to radially compress the radially diverging jack engagement portion against the outer surface of the jack and thereby lock the connector thereto.

41. The kit of parts set forth in claim 40 wherein the slideable shell means is adapted to guide the snap ring into position over the coaxial cable end and mandrel body during assembly of the connector and installation thereof onto the prepared end.

42. The kit of parts set forth in claim 41 further comprising an installation tool carrying in nested relation the mandrel body, snap ring and slideable shell means, so that the prepared cable end may be pressed into position against the mandrel body as the cable is pressed against the installation tool.

43. The kit of parts set forth in claim 42 wherein the installation tool enables visual inspection of the cable end relative to the mandrel position after the cable end has been pressed into position.

44. The kit of parts set forth in claim 28 wherein the tubular mandrel body is formed of a metal alloy selected from the group comprising copper, zinc and tin.

45. The kit of parts set forth in claim 44 wherein the tubular mandrel body is provided with a plating of material including tin to improve lubricity characteristics.

46. The kit of parts set forth in claim 28 wherein the jack engagement portion includes plural slots and functions as a compression collet to lock onto the outer surface of the jack as the slideable shell means is positioned toward the connector end facing the jack and further comprising an installation tool carrying in nested relation the mandrel body, snap ring and slideable shell means, the installation tool having keying means for keying to the plural slots so that the installation tool and mandrel body may be rotated onto the prepared cable end as the cable is pressed against the installation tool.

47. The kit of parts set forth in claim 46 wherein the installation tool includes a central plug portion defining an inner wall, and an opening defined through the inner wall, the opening being sized to admit the center conductor of the prepared cable end and not admit a dielectric wall formed by a dielectric core of the prepared cable end, the dielectric wall adapted to come into contact with the inner wall of the installation tool central plug portion and thereby disengage the keying means from the plural slots thereby to disengage the installation tool when the mandrel body has been rotated onto the prepared cable end for a predetermined distance.

48. The kit of parts set forth in claim 46 wherein the installation tool enables visual inspection of the cable end relative to the mandrel position after the mandrel has been rotated into position relative to the cable end.

49. The kit of parts set forth in claim 28 wherein the cable engagement surface portion of the mandrel body has an interior bore which is generally frustoconically convergent toward the cable end, and further comprising a plurality of spaced apart longitudinal slots extending through the cable engagement surface portion and the tubular shank portion, thereby to define the cable engagement surface portion as a variable diameter collet for engaging a prepared cable ends having a dielectric core within a predetermined size range of varying core diameters.

50. The kit of parts set forth in claim 49 further comprising expendable ramping means slidably positionable over the exposed central conductor of the cable for expanding the variable diameter collet as the mandrel body is positioned onto the prepared cable end.

51. A method for assembling a feedthrough coaxial cable connector from a kit of parts at an end of a coaxial cable, the method comprising the steps of:

preparing an end of the cable by peeling back a first cylindrical portion of outer insulator covering for a first length to expose an outer conductor braid/foil layer, and peeling back the outer conductor brad/-foil layer and coaxially underlying dielectric insulator for a second length shorter than the first length thereby to expose a center solid conductor wire end portion, providing a kit of parts by the steps of preforming a tubular mandrel body of conductive material dimensioned to be pressed between a dielectric core and an outer conductor of the prepared end of the coaxial cable, the mandrel body as preformed including a cable engagement surface portion defining a projecting knife edge extending therearound, said cable engagement surface portion comprises the steps of forming a projecting knife edge extending therearound as a helix projecting upwardly form the engagement surface, the helix defining an acute angle and providing the projecting knife edge, a tubular shank portion extending from the cable engagement surface portion to a radial wall portion, and a jack engagement portion coaxially extending forwardly from the radial wall portion and coaxially disposed about the exposed central conductor and dimensioned to slide onto and contact in close fitting friction engagement an outer surface of a jack with which the assembled connector mates, and preforming a radial compression means for compressing the inside surface of the outer conductor of the coaxial cable over the knife edge of the tubular mandrel body installation, sliding the radial compression means over the prepared cable end in one direction of movement away from the prepared end, installing the mandrel body onto the prepared end of the cable, and sliding the radial compression means over the prepared end of the cable installed on the mandrel body so as to compress the inside surface of the outer conductor of the coaxial cable over the knife edge of the tubular mandrel body.

52. The method set forth in claim 51 wherein the step of forming the radial compression means is carried out by forming a snap-ring dimensioned to fit tightly over the coaxial cable at the knife edge including a portion thereof comprised of the resiliently deformable elastomeric material, and wherein the step of sliding the snap-ring over the prepared end of the cable installed on the mandrel body causes the resiliently deformable portion of elastomeric material to be radially extended by the frustoconical surface so as to snap lock the coaxial cable toward the radial wall portion and thereby cause the outer conductor to bear against the knife edge.

53. The method set forth in claim 52 wherein the step of forming the snap-ring comprises the step of forming the elastomeric portion as a spline having teeth, and wherein the step of sliding the snap-ring over the prepared end of the cable causes pointed spline ends to bite into and thereby engage an outer insulation covering of the coaxial cable thereby press the outer conductor against and cause it to bear upon the knife edge.

54. The method set forth in claim 51 wherein the step of forming the kit of parts includes the steps of forming the jack engagement portion of the mandrel body by dimensioning the portion to diverge radially from the radial wall portion, and additionally forming slideable shell means for clamping engagement over at least the jack engagement portion of the mandrel body, and comprising the further steps of installing the slidable shell means by sliding it over the cable away from the prepared cable end thereof immediately before the step of sliding the radial compression means over the prepared cable end, and then sliding the slidable shell means toward the prepared cable end thereby to carry the radial compression means over the prepared end of the cable installed on the mandrel body.

55. The method set forth in claim 54 wherein the step of forming the slideable shell means includes the step of defining an inside frustoconical portion congruent with the frustoconical surface portion of the mandrel body and wherein the step of sliding the slidable shell means toward the prepared cable end includes the step of causing the inside frustoconical surface portion to compress a region of the coaxial cable outer conductor against the frustoconical surface portion of the mandrel body.

56. The method set forth in claim 54 wherein the step of forming the jack engagement portion is carried out by forming slots longitudinally and the step of sliding the outer shell means over the mandrel body causes the jack engagement portion to compress against a jack with which the connector so formed is to be mated.

57. The method set forth in claim 51 comprising the further step of providing an installation tool for aiding the steps of sliding the radial compression means over the prepared cable end in one direction of movement away from the prepared end, installing the mandrel body onto the prepared end of the cable, and sliding the radial compression means over the prepared end of the cable installed on the mandrel body so as to compress the inside surface of the outer conductor of the coaxial cable over the knife edge of the tubular mandrel body.

58. The method set forth in claim 57 wherein the step of providing the installation tool includes the step of nesting the mandrel body and radial compression means within the tool and using the tool as a finger grip to contain, align and support the mandrel body and radial compression means as the prepared cable end is engaged by the mandrel body.

59. The method set forth in claim 57 wherein the step of providing the installation tool includes the steps of preassembling the mandrel body and the radial compression means within the installation tool for distribution to the installer/user.

60. The method set forth in claim 51 wherein the step of forming the jack engagement portion includes forming plural slots so that the jack engagement portion functions as a compression collet to lock onto the outer surface of the jack as the slideable shell means is positioned toward the connector end facing the jack and further comprising the steps of forming an expendable installation tool including keying means for keying to the plural slots so that the installation tool and mandrel body may be rotated together onto the prepared cable end as the cable is pressed against the installation tool, and arranging the mandrel body, snap ring and slideable shell means in nested relation within the installation tool, and wherein the step of installing the mandrel body onto the prepared end of the cable comprises the step of rotating the installation tool and the mandrel body onto the prepared cable end.

61. The method set forth in claim 60 wherein the step of forming the installation tool includes the step of forming a central plug portion defining an inner wall, and an opening through the inner wall, the opening being sized to admit the center conductor of the prepared cable end and not admit a dielectric wall formed by a dielectric core of the prepared cable end, and wherein the step of rotating the installation tool causes the dielectric wall to come into contact with the inner wall of the installation tool central plug portion and thereby disengage the keying means from the plural slots thereby to disengage the installation tool when the mandrel body has been rotated onto the prepared cable end for a predetermined distance.

62. The method set forth in claim 60 wherein the step of forming the installation tool comprises the step of forming the installation tool of a transparent material enabling visual inspection of the cable end relative to the mandrel position after the mandrel has been rotated into position relative to the cable end.

63. The method set forth in claim 51 wherein the step of forming the cable engagement surface portion of the mandrel body comprises the step of forming an an interior bore which is generally frustoconically convergent toward the cable end, and further comprising the step of forming a plurality of spaced apart longitudinal slots extending through the cable engagement surface portion and the tubular shank portion, thereby to define the cable engagement surface portion as a variable diameter collet for engaging a prepared cable ends having a dielectric core within a predetermined size range of varying core diameters.

64. The method set forth in claim 63 further comprising the steps of forming expendable ramping means, slidably positioning the ramping means over the exposed central conductor of the cable, passing the variable diameter collet over the ramping means to expand the diameter thereof as the mandrel body is installed onto the prepared cable end and thereupon removing the ramping means from the assembled cable connector.

65. The method set forth in claim 51 wherein the step of forming the mandrel body is carried out by the process of die casting the mandrel body from a suitable metal material.

66. The method set forth in claim 65 wherein the suitable metal material is selected from the group comprising copper, zinc and tin.

67. The method set forth in claim 51 wherein the step of forming the tubular mandrel body includes the step of plating the formed mandrel body with a plating to improve lubricity characteristics.

68. The method set forth in claim 67 where the plating step is carried out with a material including tin.

* * * * *

UNITED STATES PATENT AND TRADEMARK OFFICE

CERTIFICATE OF CORRECTION

PATENT NO. : 5,127,853

INVENTOR(S) : McMills et al.

DATED : July 7, 1992

It is certified that error appears in the above-identified patent and that said Letters Patent is hereby corrected as shown below:

Cover page, Abstract [57], line 14, replace "copmression" by --compression--.

Column 2, line 48, replace "in h" by --in the--.

Column 3, line 59, replace "an arrow" by --a narrow--.

Column 9, line 41, replace "inn" by --in--.

Column 12, line 29, replace "slidable" by --slideable--.

Column 12, line 53, replace "slidably" by --slideably--.

Column 15, line 27, after "surface" insert --74--.

Column 16, line 7, replace "48" by --58--.

Column 16, line 14, replace "embodiment" by --embodying--.

UNITED STATES PATENT AND TRADEMARK OFFICE

CERTIFICATE OF CORRECTION

PATENT NO. : 5,127,853

INVENTOR(S) : McMills et al.

DATED : July 7, 1992

It is certified that error appears in the above-identified patent and that said Letters Patent is hereby corrected as shown below:

Column 17, line 21, replace "mill" by --mil--.

Column 17, line 52, replace "3-36," by --33-36,--.

Column 18, line 4, replace "0.10" by --0.010--.

Column 19, line 6, replace "ensure" by --ensue--. Column 19, line 31, replace "790b" by --70b--.

Column 19, line 53, replace "embodiment" by --embodiments--.

Column 19, line 56, replace "he" by --the--.

Column 20:

Claim 1, line 17, replace "of the" by --to a--.

Claim 1, line 21, replace "into" by --onto--.

Claim 1, line 23, replace "makes" by --mates--.

UNITED STATES PATENT AND TRADEMARK OFFICE

CERTIFICATE OF CORRECTION

PATENT NO. : 5,127,853

INVENTOR(S) : McMills et al.

DATED : July 7, 1992

It is certified that error appears in the above-identified patent and that said Letters Patent is hereby corrected as shown below:

Column 20:

Claim 5, line 10, replace "slidably" by --slideably--.

Column 21:

Claim 10, line 12, replace "slidably" by --slideably--.

Claim 12, line 6, before "shank" insert --cable engagement surface portion and the tubular--.

Claim 12, line 8, replace "ends" by --end--.

Claim 14, line 5, replace "and" by --end--.

Claim 14, line 8, replace "and" by --an--.

Column 22:

Claim 19, line 9, replace "ends" by --end--. Claim 22, line 2, replace "i" by --is--.

Claim 22, line 6, replace "slidably" by --slideably--.

Column 23:

Claim 28, line 22, replace "makes" by --mates--.

UNITED STATES PATENT AND TRADEMARK OFFICE

CERTIFICATE OF CORRECTION

PATENT NO. : 5,127,853

INVENTOR(S) : McMills et al.

DATED : July 7, 1992

It is certified that error appears in the above-identified patent and that said Letters Patent is hereby corrected as shown below:

Column 24:

Claim 37, line 6, replace "slidable" by --slideable--.

Claim 37, line 11, replace "slidably" by --slideably--.

Claim 40, line 2, replace "i" by --is--.

Claim 40, line 11, replace "slidably" by --slideably--.

Column 25:

Claim 49, line 9, replace "ends" by --end--.

Claim 50, line 2, replace "slidably" by --slideably--.

Column 26:

Claim 51, line 7, replace "brad/" by --braid/--.

Claim 51, line 22, replace "form" by --from--.

Claim 54, line 8, replace "slidable" by --slideable--.

Claim 54, line 12, replace "slidable" by --slideable--.

UNITED STATES PATENT AND TRADEMARK OFFICE

CERTIFICATE OF CORRECTION

PATENT NO. : 5,127,853

INVENTOR(S) : McMills et al.

DATED : July 7, 1992

It is certified that error appears in the above-identified patent and that said Letters Patent is hereby corrected as shown below:

Column 27:

Claim 55, line 5, replace "slidable" by --slideable--.

Column 28:

Claim 63, line 10, replace "ends" by --end--.

Signed and Sealed this

Twenty-sixth Day of April, 1994

*Attest:*

Bruce Lehman

BRUCE LEHMAN

*Attesting Officer*

*Commissioner of Patents and Trademarks*